US012311230B2

(12) United States Patent
Ferlito et al.

(10) Patent No.: US 12,311,230 B2
(45) Date of Patent: May 27, 2025

(54) ELECTROMECHANICAL EXERCISE MACHINE

(71) Applicant: MAXXX-FORCE LLC, Fort Lauderdale, FL (US)

(72) Inventors: John V. Ferlito, Sarasota, FL (US); Nathan Macdonald, Lindon, UT (US); Fred Smith, Alpine, UT (US); Loren Sackett, Eagle Mountain, UT (US); Nathan Morrill, Lehi, UT (US); Ryan Brainard, Salt Lake City, UT (US)

(73) Assignee: MAXXX-FORCE LLC, Fort Lauderdale, FL (US)

( * ) Notice: Subject to any disclaimer, the term of this patent is extended or adjusted under 35 U.S.C. 154(b) by 257 days.

(21) Appl. No.: 17/736,303

(22) Filed: May 4, 2022

(65) Prior Publication Data

US 2023/0009699 A1 Jan. 12, 2023

Related U.S. Application Data

(60) Provisional application No. 63/184,823, filed on May 6, 2021.

(51) Int. Cl.
*A63B 24/00* (2006.01)
*A63B 21/04* (2006.01)
(Continued)

(52) U.S. Cl.
CPC ..... *A63B 24/0087* (2013.01); *A63B 21/0442* (2013.01); *A63B 21/0552* (2013.01);
(Continued)

(58) Field of Classification Search
CPC ..... A63B 24/0087; A63B 21/0442; A63B 21/0552; A63B 21/0724; A63B 21/0783;
(Continued)

(56) References Cited

U.S. PATENT DOCUMENTS 3,998,100 A 12/1976 Pizatella et al.
4,120,210 A 10/1978 Sloyan
(Continued)

FOREIGN PATENT DOCUMENTS

WO WO 02/04081 A1 1/2002
WO WO 2010/120378 A2 10/2010
WO WO 2012/128612 A1 9/2012

OTHER PUBLICATIONS

SchedeTecnichekineo_Med_En_09_2019_Multistation.pdf, Sep. 2019.
X-force.se/index.php/negativetraining, Mar. 2, 2021.

*Primary Examiner* — Megan Anderson
*Assistant Examiner* — Andrew M Kobylarz
(74) *Attorney, Agent, or Firm* — David B. Tingey; K. Russell Griggs; Kirton McConkie

(57) ABSTRACT

An electro-mechanical displacement exercise apparatus for processing a maximum force potential of an athlete, including a frame a frame including a platform, wherein a section of the platform is connected to a tower, whereby the tower houses control means for manipulating a tension supporting member connected to a force bearing member, a first pull location, whereby the first pull location is positioned on the platform and within the frame and whereby the first pull location is operatively connected with a portion of the tension supporting member, whereby a user may exert a force on the tension supporting member operatively connected to a first actuator; and wherein the first actuator is housed within the tower, and whereby the first actuator includes a motor coupled to a gearbox.

62 Claims, 22 Drawing Sheets

(51) Int. Cl.
*A63B 21/055* (2006.01)
*A63B 21/072* (2006.01)
*A63B 21/078* (2006.01)

(52) U.S. Cl.
CPC ..... *A63B 21/0724* (2013.01); *A63B 21/0783* (2015.10); *A63B 2024/0093* (2013.01); *A63B 2210/50* (2013.01); *A63B 2220/20* (2013.01); *A63B 2220/51* (2013.01); *A63B 2225/093* (2013.01); *A63B 2225/102* (2013.01); *A63B 2225/20* (2013.01)

(58) Field of Classification Search
CPC ..... A63B 2024/0093; A63B 2210/50; A63B 2220/20; A63B 2220/51; A63B 2225/093; A63B 2225/102; A63B 2225/20; A63B 2071/063; A63B 2220/13; A63B 2220/17; A63B 2220/803; A63B 2230/062; A63B 21/0059; A63B 21/156; A63B 2071/065; A63B 2230/655; A63B 21/154; A63B 71/0622
See application file for complete search history.

(56) References Cited

U.S. PATENT DOCUMENTS 4,200,279 A 4/1980 Lambert, Jr.
4,787,630 A 11/1988 Watson et al.
4,846,466 A 7/1989 Stima, III
4,865,315 A 9/1989 Paterson et al.
4,930,770 A 6/1990 Baker
4,949,959 A 8/1990 Stevens
5,242,351 A 9/1993 Berg et al.
5,344,374 A 9/1994 Telle
5,407,403 A 4/1995 Coleman
5,435,798 A 7/1995 Habing
5,447,484 A 9/1995 Chandler
5,454,773 A 10/1995 Blanchard
5,697,869 A 12/1997 Ehrenfried et al.
5,752,811 A 5/1998 Petro
5,823,921 A 10/1998 Dawson
5,919,115 A 7/1999 Horowitz et al.
6,050,920 A 4/2000 Ehrenfried
6,117,049 A 9/2000 Lowe
6,224,512 B1 5/2001 Arnesson
6,368,251 B1 4/2002 Casler
6,646,431 B1 11/2003 Parvez
6,702,719 B1 3/2004 Brown et al.
6,852,046 B1 2/2005 Wewel
7,000,658 B1 2/2006 Soukiassian
7,083,547 B2 8/2006 LaStayo et al.
7,278,958 B2 10/2007 Morgan
7,341,546 B2 3/2008 Gautier
7,803,095 B1 9/2010 LaGree
8,187,153 B2 5/2012 Douglas et al.
8,287,434 B2 10/2012 Zavadsky et al.
8,388,504 B2 3/2013 Ellis
8,475,338 B2 7/2013 Greenhill et al.
8,572,049 B2 10/2013 Cheung et al.
8,910,917 B1 12/2014 Bees
8,973,460 B2 3/2015 Duplony
9,144,709 B2 9/2015 Reich et al.
9,272,186 B2 3/2016 Reich et al.
9,586,091 B2 3/2017 Reich et al.
9,707,435 B1 * 7/2017 Ferlito ..... A63B 21/28
10,265,567 B2 4/2019 Wilt
10,335,626 B2 7/2019 Orady et al.
10,486,015 B2 11/2019 Valente et al.
10,589,163 B2 3/2020 Grady et al.
10,617,903 B2 4/2020 Grady et al.
10,661,112 B2 5/2020 Grady et al.
10,792,539 B1 10/2020 Gilstrom et al.
10,874,905 B2 12/2020 Belson et al.
10,876,905 B1 12/2020 Belson et al.
10,881,890 B2 1/2021 Grady et al.
2004/0066552 A1 4/2004 Werba
2004/0254050 A1 12/2004 Morgan
2005/0159278 A1 7/2005 McVay
2006/0199700 A1 9/2006 LaStayo et al.
2007/0054784 A1 3/2007 Wu
2007/0155587 A1 * 7/2007 Huang ..... A63B 23/12 482/148
2007/0202992 A1 8/2007 Grasshoff
2010/0197462 A1 * 8/2010 Piane, Jr. ..... A63B 21/00 482/8
2010/0216600 A1 8/2010 Noffsinger et al.
2011/0237399 A1 9/2011 Toback
2012/0018249 A1 * 1/2012 Mehr ..... A63B 69/0064 182/5
2013/0190143 A1 7/2013 Greenhill
2014/0121071 A1 5/2014 Strom
2014/0213414 A1 7/2014 Balandis
2014/0228175 A1 8/2014 Lemos
2015/0115848 A1 4/2015 McFadden
2015/0148203 A1 5/2015 Rios Sodeyama
2016/0346601 A1 12/2016 Marcandelli et al.
2017/0095695 A1 4/2017 Mangusson et al.
2017/0100628 A1 4/2017 Wilt
2017/0282015 A1 10/2017 Wieks et al.
2017/0319941 A1 * 11/2017 Smith ..... A63B 24/0003
2018/0036579 A1 2/2018 Dwork et al.
2018/0154205 A1 6/2018 Watterson
2018/0214729 A1 * 8/2018 Rubin ..... A63B 24/0087
2019/0168052 A1 6/2019 Alexander et al.
2019/0366148 A1 * 12/2019 Hsu ..... A63B 1/00

* cited by examiner

ELECTROMECHANICAL EXERCISE MACHINE

CROSS-REFERENCE TO RELATED APPLICATIONS

This application claims the benefit of U.S. Provisional Patent Application No. 63/184,823 filed on May 6, 2021, which is incorporated herein by reference in its entirety.

BACKGROUND OF THE INVENTION

1. Field of the Invention

This invention relates to electromechanical exercise machines, and more particularly to a displacement-based exercise machine that allows a user to exert their maximal force output regardless of position, speed, or direction.

2. Description of the Related Art

Many modalities of muscle-building exercise are known in the art. Muscle building exercises generally are geared towards increasing peak muscle tension, increasing metabolic stress, and increasing total exercise volume. It is well-known that these factors tend to promote muscle hypertrophy. It is also well-known that the human body is capable of exerting significantly greater force in an eccentric direction (muscle lengthening) as opposed to a concentric direction (muscle contracting). The vast majority of exercise equipment is weight-based, wherein a user progressively exerts force against known static weights (commonly in the form of plates, dumbbells, weight stacks, machines, etc.). Traditional weight-based training has several significant drawbacks.

First, traditional weight-based exercise is highly inefficient because it is only able to accommodate a small fraction of the load capability of an athlete during the negative (eccentric) phase of each repetition. This is because an athlete needs to lift a weight before lowering it, so they must choose a weight they are capable of lifting. As a result, an athlete must choose a weight they are capable of lifting at their weakest position in the chosen exercise. For example, if an athlete is doing a barbell squat type exercise, they must be careful to choose a weight they can handle at the bottom of a repetition, where they have the lowest mechanical advantage. However, the same athlete is capable of supporting substantially larger loads at the top of the repetition as their mechanical advantage over the weight will be greater. Further still, an athlete will be capable of handling even more weight at the top of the repetition and in the negative (or eccentric) direction. These discrepancies between loading and athlete capability are universally present in weight-based exercise.

Second, the dynamics of weight-based exercise are the reverse of what would tend to match the force generating capability of an athlete. During the lowering (eccentric) phase of a repetition for a given exercise (when an athlete is capable of sustaining the largest loads), the apparent load an athlete feels is reduced by dynamics. The extent of this effect is dependent on how quickly the weight is lowered. Under extreme conditions, the apparent load may be reduced to zero (for instance, if the user drops the weight to the bottom). However, the apparent weight is greater during the athlete's weakest condition in that the apparent weight is heavier during the concentric phase of each rep. The magnitude of this effect again depends on how quickly/explosively a weight is moved but may be significant.

Thirdly, weight-based exercise does not easily allow a user to adjust the resistance/weight during a set or a repetition. As described in the first disadvantage, an athlete generally must choose a fixed quantity of weight to move through exercising motions. Some weight-based or even elasticity-based exercises are available to allow weight to vary depending on the position. For example, heavy chains may be added to an exercise bar such as a barbell allowing higher loads to be suspended at the top of a repetition. Alternatively, elastic bands may be applied to a barbell similarly to provide higher tension at the top of a repetition. While this partially corrects for a change in mechanical advantage during an exercise movement, it does not allow an athlete to utilize their maximum force potential throughout the range of motion of each repetition. Both heavy chains and elastics can only provide position-dependent weight but not direction-dependent weight. Because of this, they are not capable of following an athlete's significantly higher capacity in the eccentric direction.

As a result of the above factors, there exists a need to overcome the disadvantages of weight-based or elastic-based exercise to allow an athlete to apply their maximum force on every repetition of every set. Doing so allows an athlete to stimulate higher rates of muscular hypertrophy in shorter amounts of time as compared to weight-based exercises. Many methods have been attempted to take full advantage of the human body's force generating capability, particularly including the excess force capability associated with eccentric exertion (eccentric training).

One common method of eccentric training involves transitioning between two-limbed and single-limb exercise. For instance, an athlete may perform a pull-up with two arms on the concentric phase and then lower themselves with a single arm. Or they may curl a dumbbell with two hands and then lower it with one hand. However, this method is cumbersome and may only be doable for a very small selection of exercises. Another common method is to use momentum to get a weight up and lower it slowly. Cheater reps (as they are known) are not only cumbersome, only marginally effective, and are also prone to cause injury. No weight-based or elastic-based lifting strategy allows an athlete to safely, easily, and effectively take advantage of their full lifting capacity at every point of every repetition.

Various machines have been developed which attempt to allow athletes to use their full strength potential throughout the range of motion. However, such machines still have one or more of the following disadvantages: They are prohibitively expensive. They do not provide adequate force capability. They are still force-based (or simulated weight-based) as opposed to displacement-based. They are extremely limited in that they only accommodate a single type of exercise. They present significant unresolved safety problems. Or they do not allow for mid-repetition speed and direction flexibility as they produce only isokinetic exercise.

A need exists for displacement-based exercise machines that provide greater force capacity and greater versatility while still ensuring user safety. The foregoing challenges and design considerations, as well as others, are addressed by the present invention.

SUMMARY OF THE INVENTION

Consistent with the foregoing objects and in accordance with the invention as embodied and broadly described herein, a method and apparatus are disclosed in several embodiments.

The present invention includes at least one displacement-based controller which sets the allowable position of an exercise implement. This allows a user to develop their maximum force at any or every point of every repetition. Because the present invention is displacement-based, it is capable of accepting the maximum force potential of an athlete exerting through varying mechanical advantage regardless of direction or athlete fatigue. Because the present invention is also capable of exerting a force that tracks with an athlete as they fatigue, they are also able to produce metabolic stress much more rapidly as the machine simulates a continuously variable pyramid set in such a way that would be impossible using weight-based exercise.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through the use of the accompanying drawings in which:

DETAILED DESCRIPTION OF THE PREFERRED EMBODIMENTS

It will be readily understood that the components of the present invention, as generally described and illustrated in the figures herein, could be arranged and designed in a wide variety of different configurations. Thus, the following more detailed description of the embodiments of the system (and method) of the present invention, as represented in FIGS. 1 through 22, is not intended to limit the scope of the invention, as claimed, but is merely representative of certain embodiments of apparatus and methods in accordance with the present invention.

The embodiments of systems in accordance with the present invention will be best understood by reference to the drawings, wherein like parts are designated by like numerals throughout. Those of ordinary skill in the art will, of course, appreciate and that various modifications may easily be made without departing from the essential characteristics of the invention.

Figure 1:
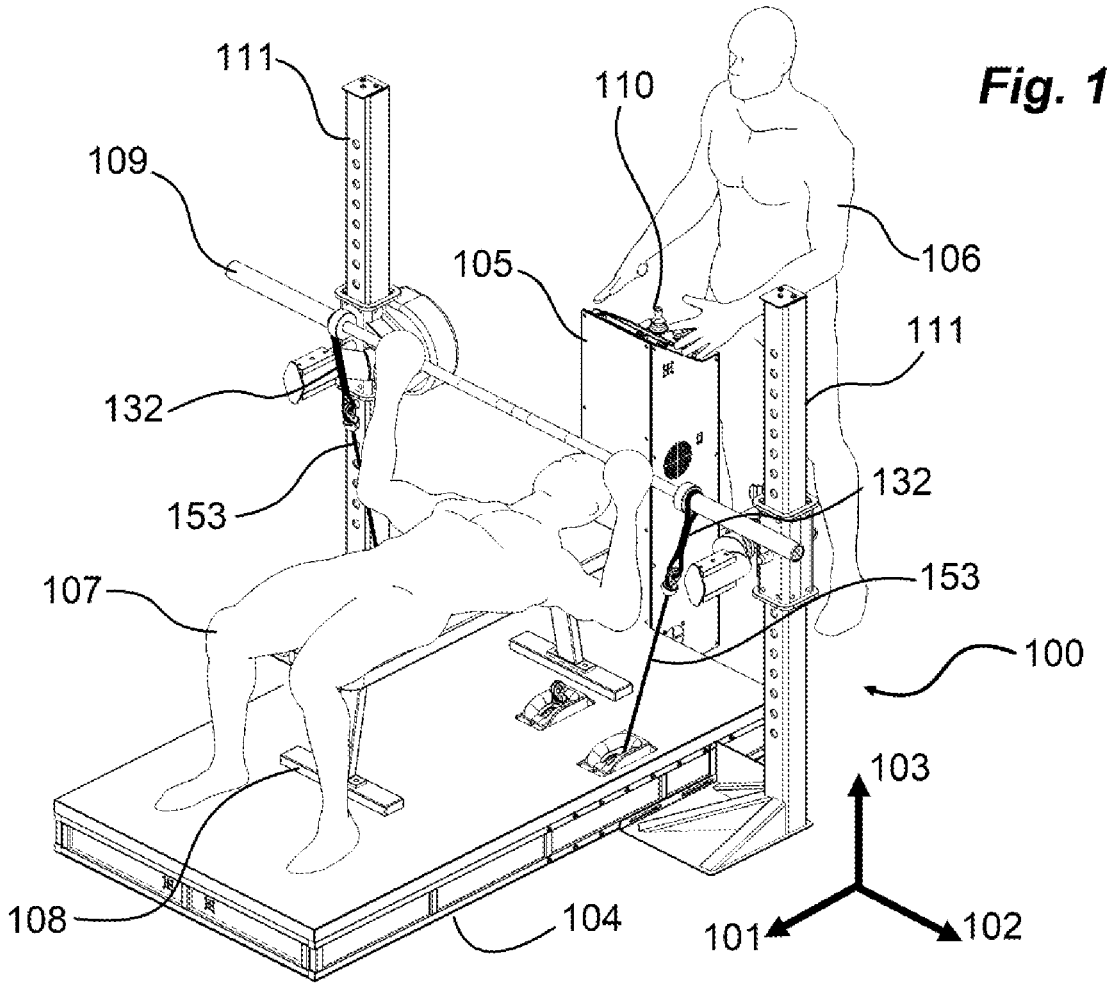
FIG. 1 is a perspective view of a first embodiment of the present invention, demonstrating one way that it may be used.

Referring to FIG. 1, in describing a first embodiment of an electromechanical exercise machine 100 in accordance with the present invention, it may be advantageous to first define longitudinal 101, transverse 102, and vertical 103 directions positioned to be substantially mutually orthogonal. In general, the longitudinal direction 101 will be aligned with the length of a platform portion 104 of the exercise machine 100. The transverse direction 102 will extend from side to side. By default, the vertical direction 103 will then be aligned with a direction generally up-and-down. All directions are with respect to the electromechanical exercise machine or apparatus 100. The terms exercise machine as well as exercise apparatus are used interchangeably throughout.

The structures on this exercise machine 100 typically accomplish several key functions, as will be described in detail. The primary and most fundamental function of this exercise machine 100 is to facilitate displacement-based exercise efficiently and safely so as to enable athlete strength to be developed more rapidly. This primary function is accomplished by allowing a user to perform a wide array of exercises for every major muscle group in the body.

Referring more specifically to FIG. 1 An electromechanical exercise machine 100 is generally composed of a platform portion 104 attached to a control tower section 105. A coach 106 assists a user 106 with performing exercise by manipulating controls 110 on the control tower 105. It is noted that throughout the application the term user 106 may also refer to an athlete and the term user 106 may be used interchangeably with athlete. It is further noted that throughout the application the term coach 106 is used interchangeably with the term trainer or operator. In certain instances as further described herein, a user may also be an operator of the machine 100. As depicted in FIG. 1, user 106 is performing a bench press exercise by pressing in the vertical direction on a standard Olympic barbell 109. Tension supporting members, such as ropes 153, extend to a variable length out of platform section 104 and connect to barbell 109 via two force bearing members, such as slings 132 (one on each side). Coach 106 controls the machine 100, and specifically, the length of exposed ropes 153 as it moves into and/or out of the platform 104 by manipulating the controls 110. Tension supporting members may be rods, ropes, chain, or other mechanical means and may be rigid or flexible. Force bearing members may be handles, bars, slings, or other means. It is appreciated the term ropes 153 include by way of example and not limitation, fiber ropes, cables, steel cables, cord or handles. Coach 106 controls the machine 100, and specifically, the length of exposed ropes 153 as it moves into and/or out of the platform 104 by manipulating the controls 110. A person of ordinary skill in the art will recognize that incline and decline bench press exercises (as well as a litany of other exercises) can also be performed on the present invention without departing from the scope of this disclosure. Additional exercises may be performed with force bearing members such as any standard cable attachments or barbells. Many variations are possible. It is well-known that performing a bench press exercise presents a hazard wherein the athlete is at risk of becoming impinged between the barbell and the bench. Because the present invention is no exception to this, a set of safety rails 111 are provided, which are set at least as high as the chest height of the user 106 so as to mitigate a crushing hazard. Alternatively, this first embodiment is sized such that it will fit into a standard power rack or squat rack of ordinary design, in which case the safety rails 119 may be replaced by the safety rails of a standard rack. Safety rails 119 are connected to collars 155 which slidably engage with posts 111. In a preferred embodiment, the post(s) 111 is/are connected to the exercise machine and oriented generally upright and generally in the vicinity of the platform 104.

Figure 2:
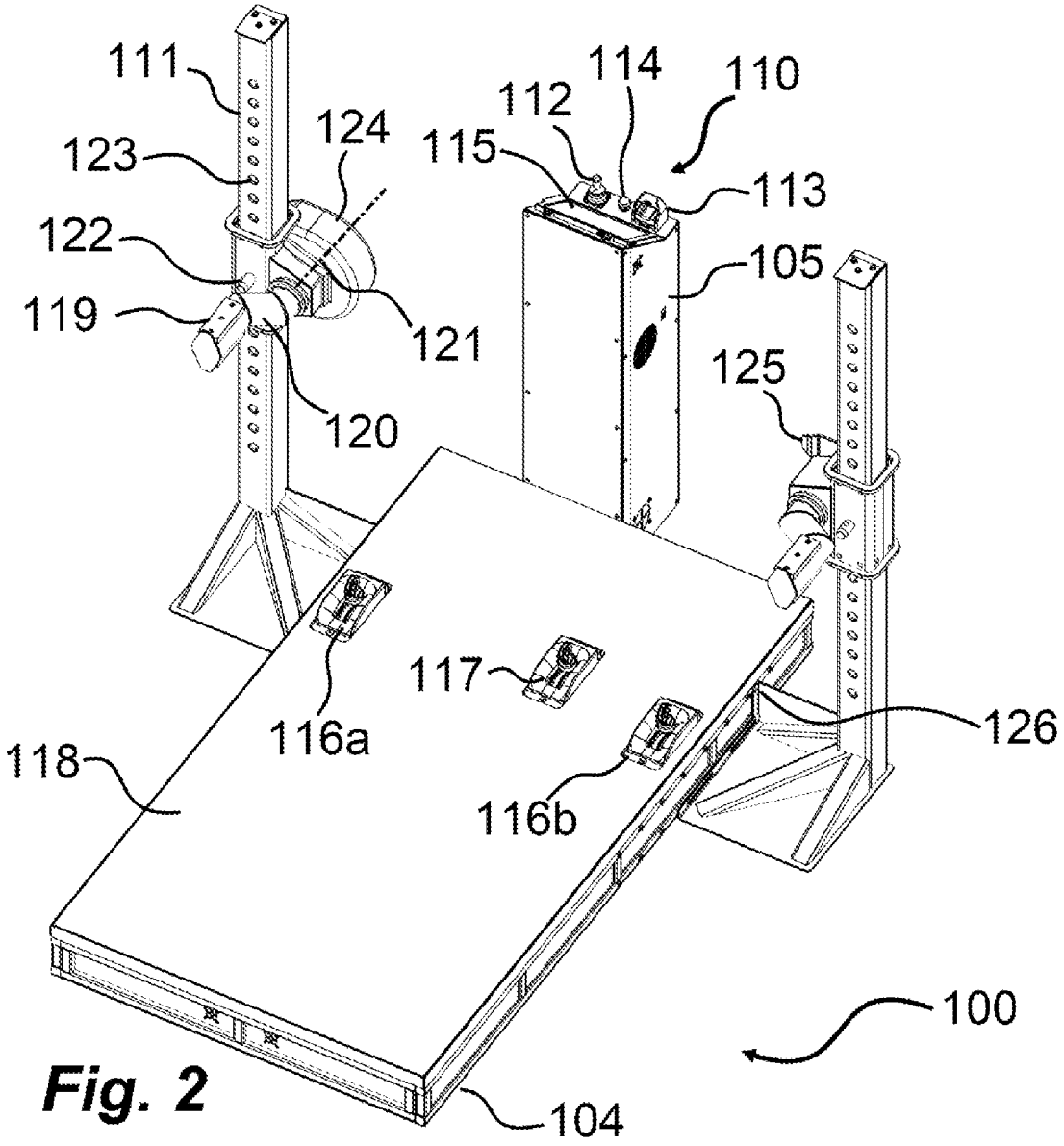
FIG. 2 is a perspective view of a first embodiment of the present invention.

Referring specifically to FIG. 2, the electromechanical exercise machine 100 is shown without a coach or user 106. Machine 100 includes three pull locations 116*a*, 116*b*, and 117 (through as few as one may also be considered), which are spaced apart in the transverse direction.

Figure 3:
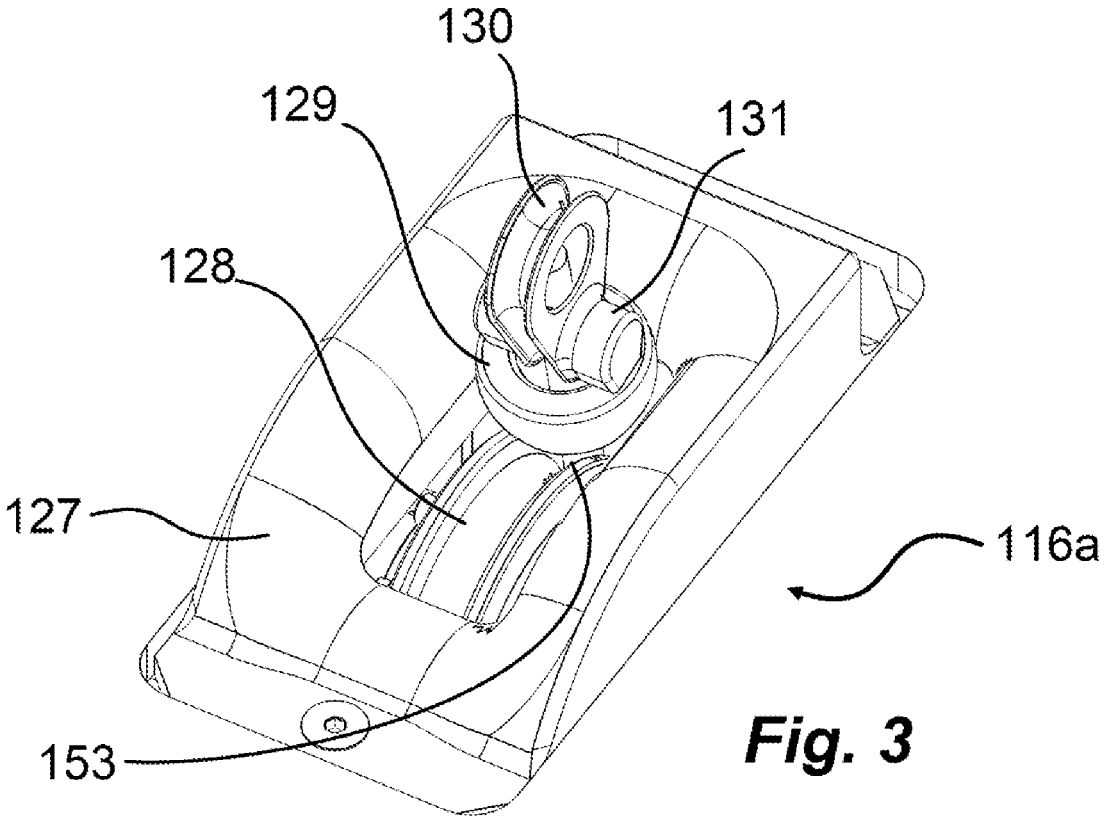
FIG. 3 is a perspective view of a pull location as used in the present invention.

As seen in FIG. 3, each pull location (116*a*, 116*b* and 117) may have a fairlead 127 situated over a pulley 128 (of ordinary design), which acts to guide a flexible tension supporting member 153 such as a rope or cord into a groove, opening or channel of the pulley 128. The fairlead consists generally of a shaped structure with one or more contoured surfaces and is positioned such that it enables a flexible tension supporting member to be guided onto or off of a pulley. The rope or cord 153 may terminate at a thimble 130 of novel arrangement equipped with two protuberances 131. A ball-stop 129 is situated between the thimble 130, the fairlead 127, and pulley 128. This allows the rope or cord 153 to be extended from the platform portion 104 of the machine but prevents it from being retracted into the platform portion 104. Alternative means (including traditional thimbles) may be used to terminate rope 153 without departing from the scope of the present invention. Thimble 130 is suitable for attachment to a force bearing member such as a handle, rope, bar, etc., through a carabiner (not shown) or sling 132 or the like.

Further, in FIG. 2, a platform portion 104 of the machine 100 may be equipped with a rubberized floor 118 such as is typical of gym flooring. This provides a low-impact surface that is familiar to a typical user such as an athlete. The user controls 110 on the control tower 105 preferably consist of a directional control instrument, such as a joystick 112, an operator presence sensor 113, an E-stop 114, and a display device such as a screen 115. Other arrangements of controls are possible within the scope of the present invention. For example, a set of buttons may be used as a directional control instrument in place of a joystick. In the present arrangement, the joystick 112 is provided with a spring-center bias such that activation and operation of the equipment requires continued input from the coach 106. If the coach releases the joystick, it automatically moves back to center and all motion stops. This aids in the safety of the machine as it requires the continuous input from the coach to operate. The operator presence sensor 113 (shown as a finger sensor of ordinary design also called a touch switch) also enhances the safety of the user 106 as it further increases the requirement for the coach's presence and attention to operate the machine (i.e., both of the coach's hands are required to operate the machine). The operator presence sensor may be equipped with a time-out function so as to prevent tie-down of the presence sensor 113, such as by permanently installing a small block into it. Thus, safety is improved because continuous operation of the controls requires continuous input from the coach, thereby requiring and maintaining the coach's presence and attention. An E-stop button 114 is also provided conveniently between the joystick 112 and the operator presence sensor 113, which allows a coach to shut the machine down in case of emergency, for instance in the event the machine malfunctions. A touchscreen 115 may be provided with a graphical user interface for machine 100, including workout setup, reporting real-time force and extension data, etc. Advantageously, an exercise machine according to the present invention may be configured such that the touchscreen 115 is only responsible for the user interface while the low-level functionality of the machine (especially including the safety controls) may be handled on a hardware-basis. In this way, the reliability and therefore safety of the machine can be further improved.

Figure 4:
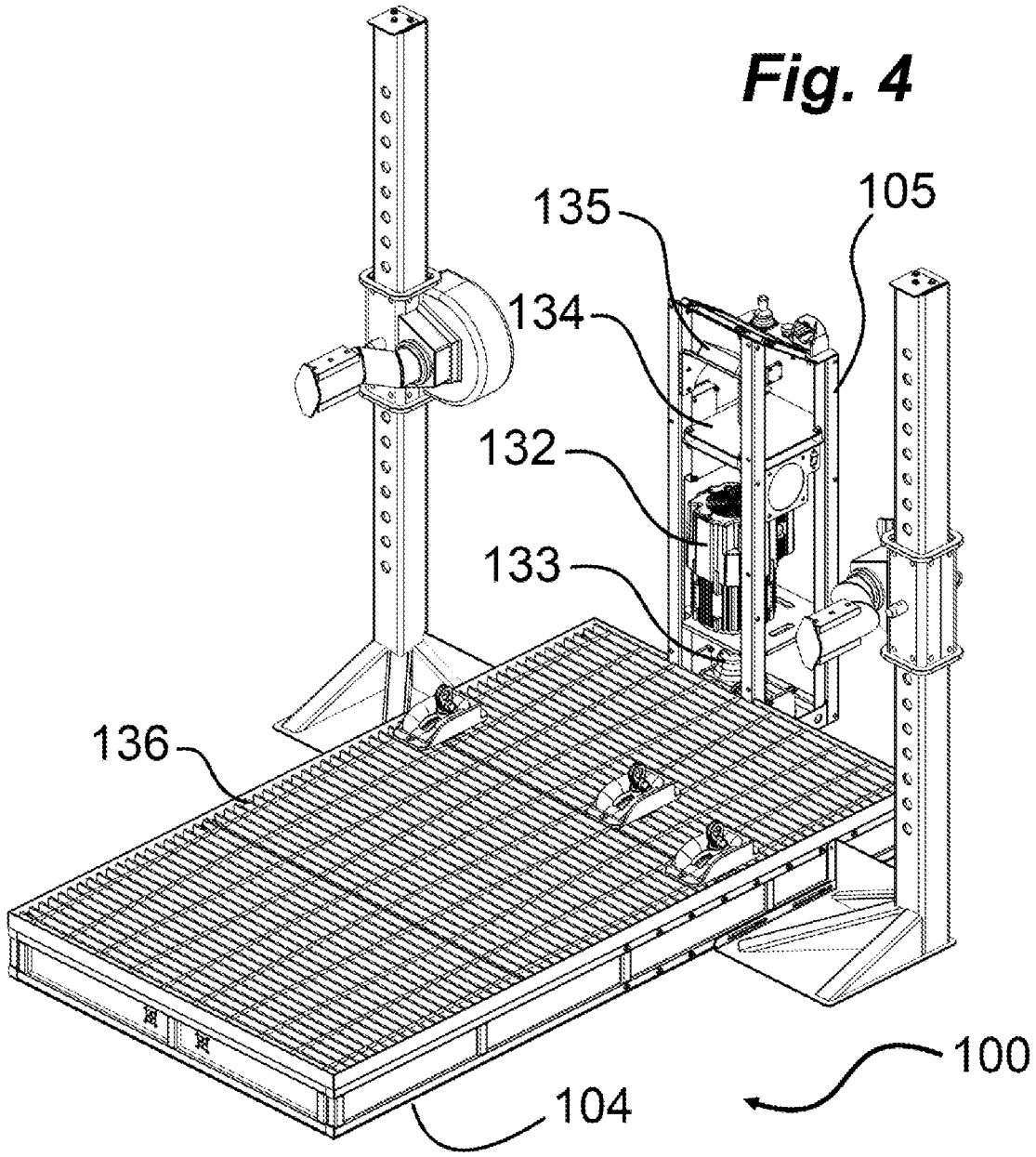
FIG. 4 is a perspective view of a first embodiment of the present invention with covers removed.

Referring more specifically to FIG. 4, the machine 100 is shown with the rubberized floor 118 and cover panels of control tower 105 removed to show components underneath more clearly. Floor paneling 136 is provided underneath the rubberized flooring 118. The floor paneling 136 may be provided as standard tread grating (as shown), but other forms are also contemplated, such as sandwich paneling or the like, which may provide adequate support with light weight. The main drive input components are housed inside the control tower 105, including a high-power motor 132, preferably a servo motor 132 coupled to a gearbox 133, preferably a miter gearbox 133, which provides drive input into the platform components. The tower includes space for mounting electronics 134 and may also include a control system such as a PLC or an industrial computer 135 or other types of electronic processors. In a preferred embodiment, the control system 135 is for directing movement of an actuator 281. A directional control mechanism for relaying a signal from the user 106 to the control system 135 may also be provided. It is understood that the signal may be an electrical, mechanical or hydraulic signal.

Figure 5:
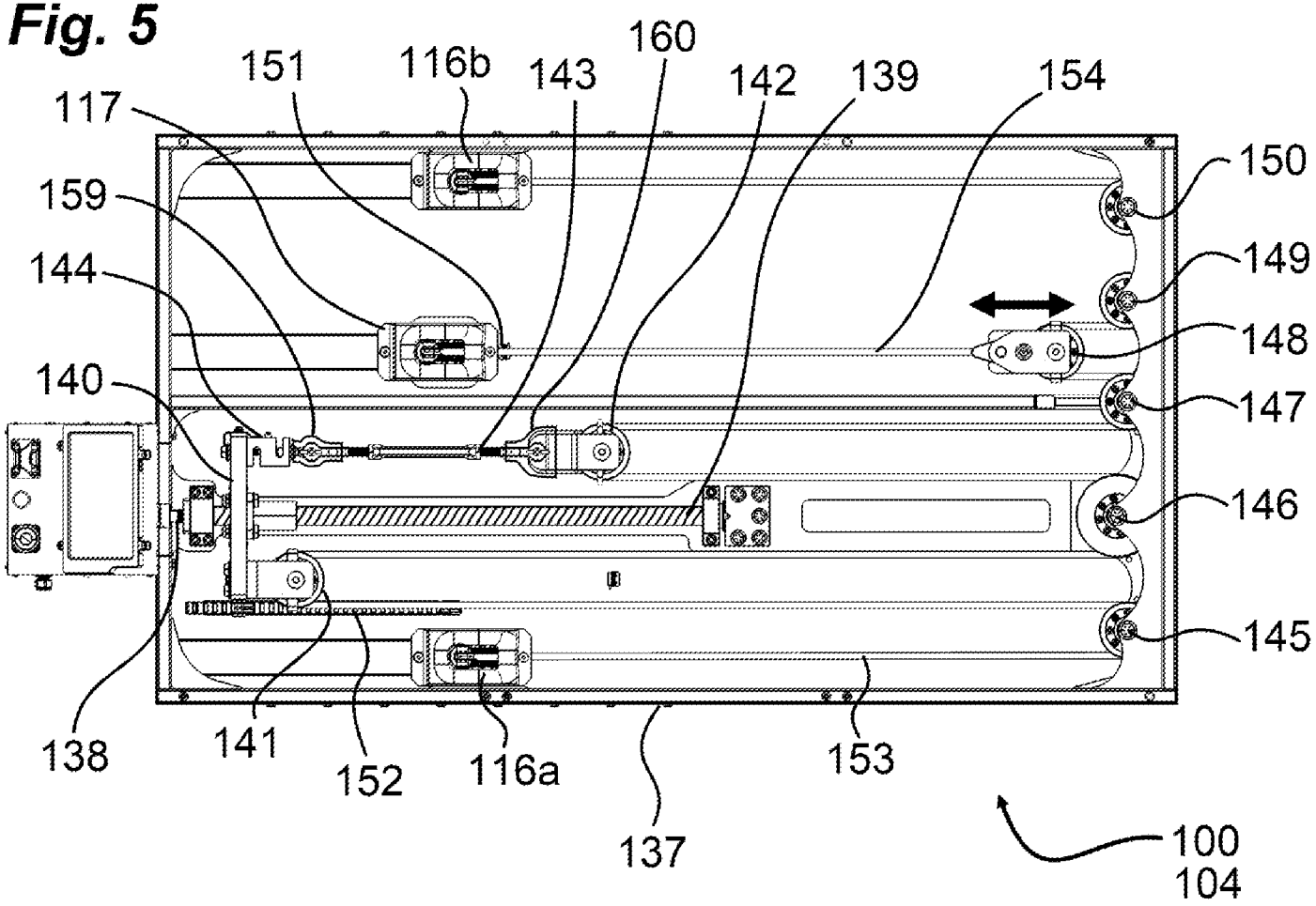
FIG. 5 is an aerial view showing the internal components of a first embodiment of the present invention.

Referring more specifically to FIG. 5, a top-down view is shown of machine 100 with the rubberized flooring 118 and floor paneling 136 removed to show the internal components mounted in frame 137 of the platform portion 104. FIG. 5 shows specifically how the output shaft 138 of the miter gearbox 133 is connected to the pull locations 116*a*, 116*b*, 117. As shown in FIG. 5, the output shaft 138 of miter gearbox 133 is connected to a ball screw system 139. An alternative driving means may be implemented, such as a screw, winch drive, a linear actuator, fluid power cylinder, a chain and sprocket drive, a belt drive, or any linear actuation device known in the art. The actuator, where used, allows the machine to be operated (retracting and extending the tension supporting members) in s manner other than manually. The ball screw system 139 is provided with a carriage 140, which may travel relative to the platform portion 104 in the longitudinal direction. Carriage 140 has a first pulley 141 and a second pulley 142 connected to it. The second pulley 142 is connected to carriage 140 through a turnbuckle 143 and a force measurement device such as a load cell 144. Alternatively, the force may be measured by, for instance, measuring the torque on the motor or other means. The turnbuckle is provided for tensioning of the system, while the load cell 144 allows the system to measure the force exerted by the athlete on the system. An energy chain 152 of typical design allows the signal from the load cell 144 to travel from the moving carriage 140 to the stationary frame 137 of the platform portion 104 and from there to the electronics mounted at 134 or computer 135 for further processing and analysis. A first rope or cord 153 and a second rope or cord 154 are provided, which functionally connect the output shaft 138 of the miter gearbox 133 to the three pull locations 116*a*, 116*b*, 117. The first rope or cord 153 begins at one of the outer pull locations 116*a* and passes around pulley 145 towards the carriage pulley 141. The rope 153 next passes around pulley 146 before doubling back to carriage pulley 142. From there rope 153 passes around pulley 147 onto sliding pulley 148, which can slide in platform frame 137 in the longitudinal direction. From the sliding pulley, the first cord passes around pulleys 149 and 150 before terminating at the opposite outer pull location 116*b*. The second cord 154, runs from the central pull location 117 to the sliding pulley 148. Each pulley is provided with rope retention means which prevent rope or cord from derailing from the respective pulleys in conditions where rope tension may be low. Optionally, flexible stabilizing elements 159, 160 may be provided at the turnbuckle joints in concert with the pulley rope retention to allow the carriage 140 to be moved without an athlete exerting on any of the pull locations (116*a*, 116*b*, 117) without the rope derailing or the load string becoming unstable. This provides additional ease of use, as a user is prone to drop an attachment (for instance, when completing a set) or forget to pull on an attachment at various points in a workout. Sliding pulley 148 is capable of traveling from the position shown in FIG. 5 towards central pull location 117, where a limit switch or a magnetic switch 151 is provided. The magnetic switch 151 may be used to indicate to the system that it has reached a limit and to discontinue the movement of the carriage 140.

One of ordinary skill in the art will recognize the advantages afforded by the novel arrangement of the ball screw system 139, pulleys, and ropes 153, 154 as it allows a single actuator to be able to control three pull locations. This provides significant cost savings on this embodiment of the present invention. The present invention is intended to be utilized by exerting on either the central pull location 117 or both of the outer pull locations 116*a*, 116*b*. One of ordinary skill in the art will recognize that the force seen on the load cell 144 is the same magnitude regardless of whether the athlete pulls on the center pull location 117 or both of the outer pull locations 116*a*, 116*b*. As an alternative embodiment, two independent drive systems may be used (one for the central pull location 117, and one for the outer pull locations 116*a*, 116*b*). One of ordinary skill in the art will recognize that an independent actuator and drive system can be used for every pull location in the platform portion.

The machine is designed such that the servo motor 132 is capable of controlling the position of carriage 140 against undesired movement as force is applied at any of the three pull locations 116*a*, 116*b*, 117 by a user. This is due to the arrangement of the pulley system internally which functionally connects the motor to the tension supporting members at each pull location. The position of the servo motor 132 controls the exposed rope length at the pull locations (either the center pull location 117 or both of the outer pull locations 116*a*, 116*b*). Assuming a user is exerting against the servo, the servo's position then directly controls the displacement of the system. In practice, coach 106 may adjust the position, speed, and direction of the servo according to the athlete's needs and may even respond to verbal feedback from the athlete if desired. In this way, the entirety of every rep and every set is individually controllable, and the athlete can exert their maximum force potential through the entire range of motion. The control system which may take on the form of an on-board computer system records the displacement (from a position measurement device such as an encoder in the servo motor 132), and force data (from the force measurement device such as a load cell 144) collected and displays it in real-time on screen 115. A coach may, for instance, decide to insert a pause in the middle of a given rep, allowing an athlete to settle into a position and develop their true maximum force potential. They may choose to reverse direction in the middle of a repetition to put focused work on the central portion of a repetition where the best balance between muscle tension and joint load exists. In the same set, however, the coach may still allow an athlete to train on the extreme position of a rep for a full balanced workout. All of this flexibility on-the-fly is afforded by the novel arrangement of parts as described in the present invention.

Figure 6A:
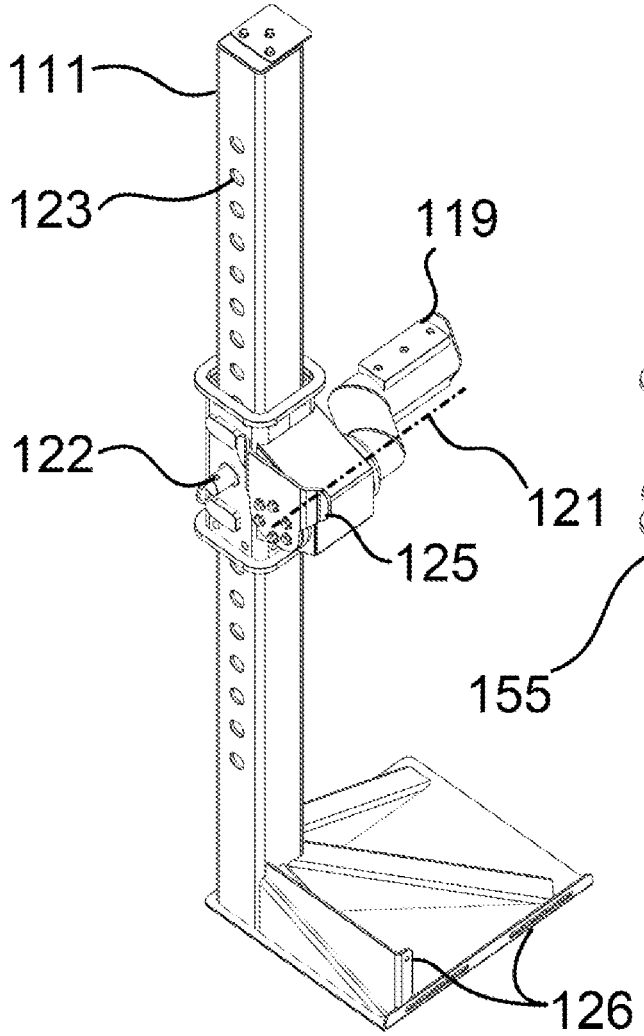
FIG. 6A and FIG. 6B present perspective views of different positions of a safety rail mechanism as may accompany the present invention.
Figure 6B:
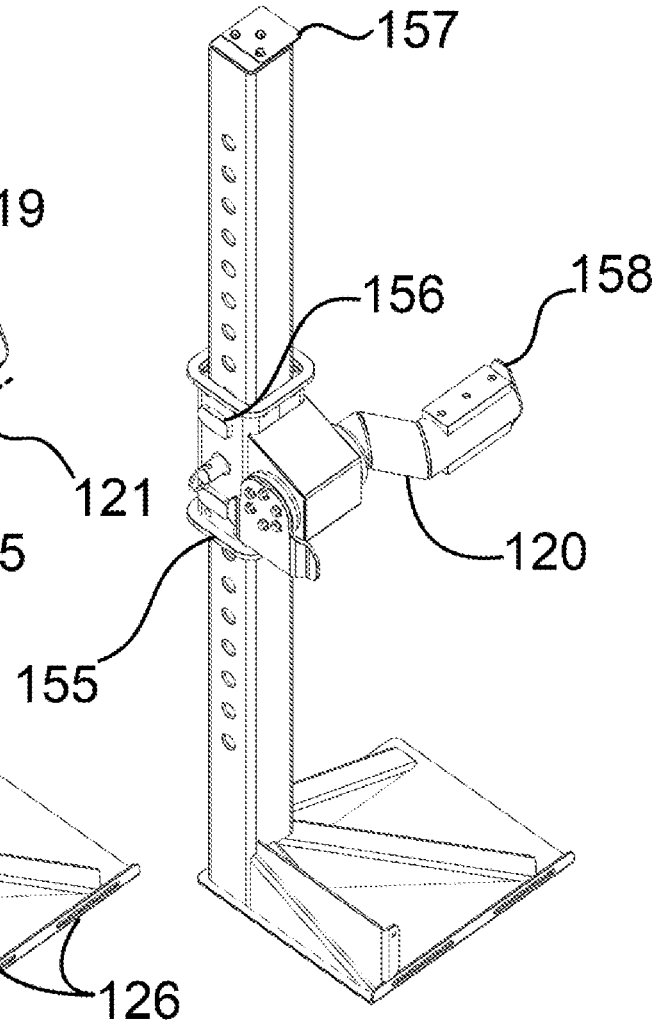

Referring particularly to FIGS. 2, 6A, and 6B, the safety rails 119 are supported on vertical posts 111 with holes 123 at periodic intervals by means of collars 155 which slidably engage with vertical posts. The safety rail 119 can be positioned vertically along with the post and secured by pin 122 that goes through one of the holes 123 as well as the collar portion 155 of the vertical post 111. The safety rail 119 includes a jog portion 120 to a rotational axis 121 which allows the support arm 119 to be toggled between a narrow and a wide position. A stopper plate 125 supports the support arm in each of these two toggle positions as it rests against a stop 156 in the upper or lower position. In the wide position (shown in FIGS. 2 and 6A) the support arm 119 is pivoted to a wide position about axis 121 which will tend to support a standard Olympic barbell 109 at a wider location that will allow an attachment means such as a sling 132 (as shown in FIG. 1) to be looped on to the barbell without interference with the rack. The support arm may also be rotated 180 degrees about axis 121 to a narrow position (as shown in FIG. 6B) that will support a standard Olympic barbell 109 at a traditional position on the outermost portion of the handle grip bar. A safety cover 124 may be provided to guard against pinch point hazards. The posts 111 may be attached to the platform portion 104 via tabs and hardware provided at 126. A vertical stop 157 may also be provided to limit the position of the slider 155 and to prevent it from being removed. Finally, a forwardmost plate 158 is preferentially provided, which prevents a barbell from rolling off the safety rail 119.

Figure 7:
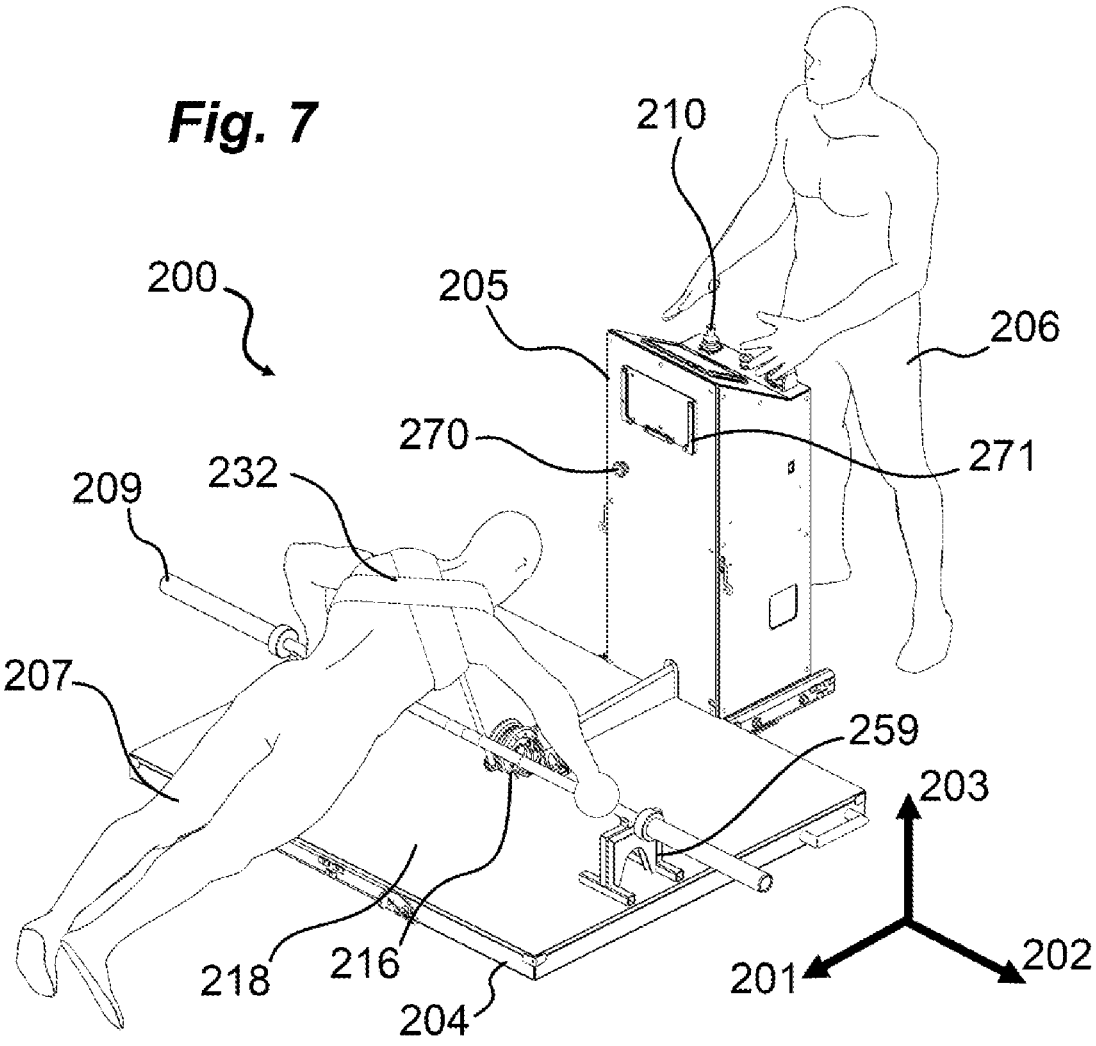
FIG. 7 is a perspective view of a second embodiment of the present invention, demonstrating one way that it may be used.

According to a second embodiment of the present invention, an electromechanical exercise machine/apparatus with a single pull location is disclosed. The second embodiment is generally laid out similarly to the first embodiment. As shown in FIG. 7 the longitudinal direction 201 is similarly oriented front to back. The transverse direction 202 is oriented side-to-side, while the vertical direction 203 is oriented up and down. As shown in FIG. 7, a user 207 performs an externally loaded pushup on a standard Olympic bar 209, which is suspended off the ground by two barbell holders 259. The user 207 is hooked into the single pull location 216, of the second embodiment via a force bearing member such as a shoulder sling 232 (alternatively through a standard dips belt). The length of exposed rope is controlled by a coach 206 operating controls 210 on the control tower 205. Because there is only a single pull location the safety of the second embodiment is enhanced as compared with the first embodiment, which has three pull locations as it is more difficult to create a crushing hazard. The barbell holders 259 are at a height that makes it difficult to attach a sling or dips belt of ordinary design to the machine and be able to have enough range of motion to create a crushing hazard. As it is unlikely, though not entirely impossible, to create a crushing hazard, many other safety measures are still in place, as in the first embodiment 100.

Figure 8:
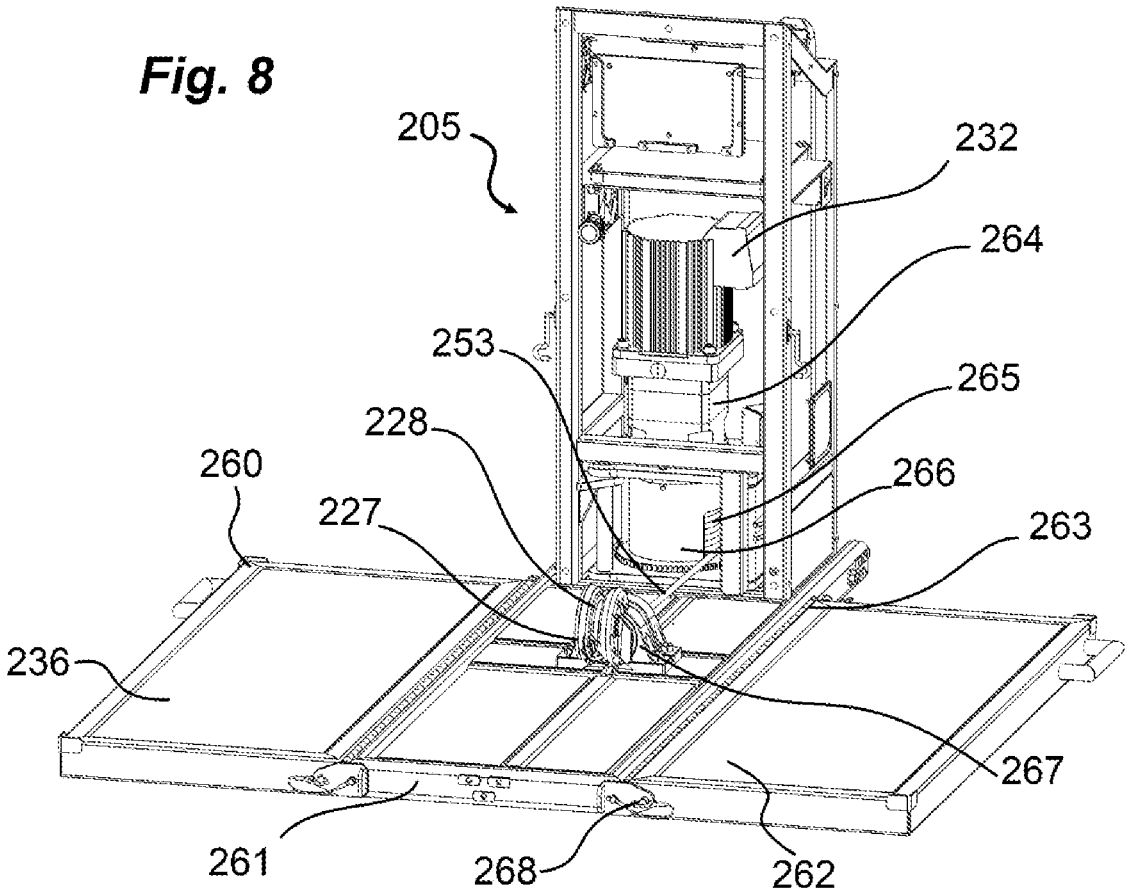
FIG. 8 is a perspective view of a second embodiment of the present invention with covers removed.

As shown in FIG. 8, the second embodiment machine is shown with rubberized flooring 218 removed as well as cover panels from the control tower 205. The second embodiment machine platform portion 204 may be provided with two or more distinct segments. A first segment 261, is situated as a central platform segment and comprises the main frame of the platform portion 204 of the second embodiment machine. Two folding wing segments (260 and 262) are attached to the central segment 261 through the use of hinges 263. Alternatively, the segments may be positioned in a stowed or deployed position without folding, for instance by mechanically fastening or hooking, etc. Thus, the segments 260, 261 or 262 may be deployed wherein the segments are positioned in a substantially planar configuration such that a user 106 may stand thereon to perform exercises or a stowed away position, wherein the segments are positioned in a manner that is more compact. Locking pins 268 may be used to lock the wing segments in the deployed (downward) position when machine 200 is in use. Sandwich panels 236 are installed in each of the three platform segments (260, 261, and 262) to provide a lightweight load bearing floor solution. The drive system is comprised of a servo motor 232 connected to a gearbox 264, which drives a winch block 265 with a rope or cord 253 wrapped around it. Rope 253 is retained on the winch drum 265 (typically manufactured with helical rope grooves which form a channel into which the rope may travel) with the assistance of rope retention means in the form of a cylindrical keeper guard 266 which may also form a channel into which the rope may travel. Cylindrical keeper guard 266 retains rope 253 in the grooves of the winch drum 265 by providing only a small amount of clearance around the single layer of rope 253 on winch drum 265. Rope 253 passes from winch drum 265 to a swivel pulley block 267, where it terminates in the same manner as shown in FIG. 3. Alternative terminations that are known in the art may be used for fiber or wire rope as opposed to what is shown. Swivel pulley block 267 is equipped with rope guides 227 and a self-aligning pulley 228. Rope guides 227 guide rope 253 into the groove or channel of pulley 228 regardless of the pull direction as the self-aligning pulley automatically aligns itself with the direction of the rope is pulled on it.

Figure 9:
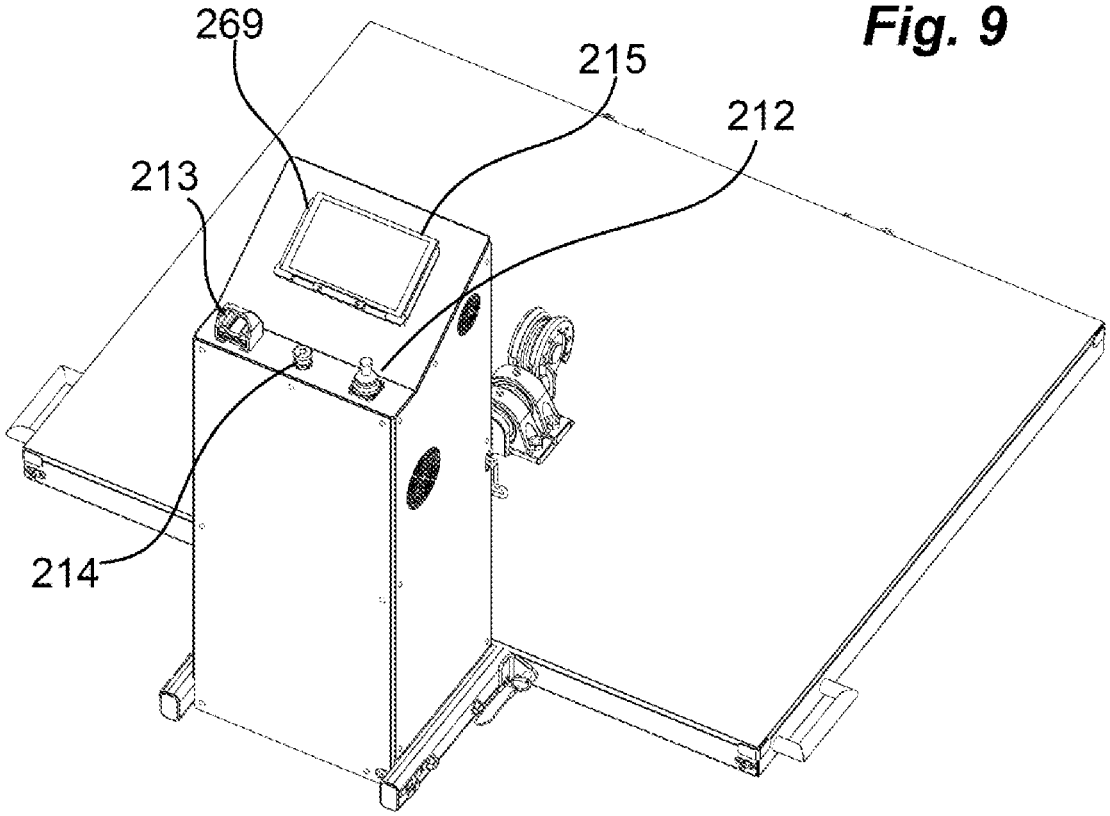
FIG. 9 is a perspective view of a second embodiment of the present invention.
Figure 10:
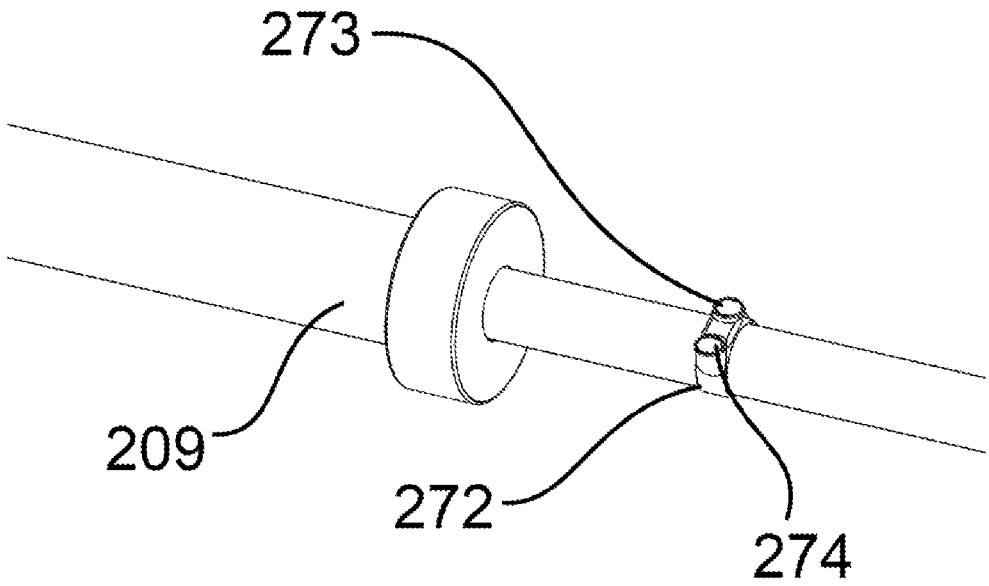
FIG. 10 is a perspective view of a single user control which may accompany an exercise machine according to the present invention.

With particular reference to FIG. 9, the controls of the second embodiment may comprise a directional control instrument such as a spring-center biased joystick 212, as well as an operator presence sensor 213, an E-stop switch 214, and touchscreen 215. As shown in the second embodiment of the present invention, the touch screen 215 may be provided in the form of a hand-held tablet which can be set in a charging station 269 or removed and used from any vantage point. The versatility of this enhancement is more pronounced with the companion enhancement of a single-user mode of operation. For use in a single-user mode, the tablet may be placed in a second charging station 271, as shown in FIG. 7. A single-user input button 270 is optionally provided on the face of the control tower 205. The single-user input button 270 may be used to select certain options in the user interfaces as well as to enable the use of a hold-to-operate single user control to move through the reps of individual sets. Single-user button 270 is depicted as a mechanical button, but may optionally be provided in any other electrical form, including for instance, a capacitive touch button or the like. Alternatively, a wired pendant or wireless hold-to-operate remote may be provided in various form factors to facilitate single-user operation of the machine as well. Once such embodiment (adapted as a wireless remote to clip on to a standard Olympic barbell) is shown in FIG. 10. In FIG. 10, a low-profile wireless remote 272 is shown, which is adapted to clip onto a standard Olympic barbell. The remote 272 is operable through the use of two buttons, 273 and 274. Each of the buttons 273 and 274 may be configured to interact with the computer system of the single-user machine to cause the servo motor 232 to release rope 253 for extension or to draw it back in to control tower 205. For safety purposes, remote 272 may be configured as a hold-to-operate control in that the machine will not move during a set unless either control button 273 or 274 is continuously pressed. The hold-to operate control may be implemented with redundant buttons in either direction (more particularly in the downward direction) with continuous self-checking to further increase the reliability and safety of the machine. Clip 272 may be placed on a barbell at a location where it may be easily operated for instance, by a thumb. Other embodiments of a single user control are also contemplated as they may be suitable for other exercises. For example, a foot switch may be designed for use in exercises that require both hands. Such a foot switch may be configured in a hold-to-operate manner such that a leftward input corresponds to a downward movement of the machine and a rightward input corresponds to upward movement of the machine. Further, the buttons on the hold-to-operate single user control may be configured to be feathered and be only pressed one at a time, either mechanically or electrically. Alternatively, a low-profile wireless remote 272 (or wired pendant) may be provided as a single user control with a single force sensitive resistor (FSR) or capacitive/inductive touch pad input. Various commands can be transmitted by the athlete to the machine via gestures input to the FSR including a single click, a double click, and various holding pressures, all of which can be translated into individual commands. For instance, a single click (tap) could be used to indicate to the machine to set a limit for the range of motion while the exercise is in the setup phase. A double click (tap) can be used to indicate that the athlete is ready to begin the set. A 3 second sustained hold, during the setup phase, can be used to indicate that the limits need to be reset. Once the athlete has begun the set, a 0-2 oz holding force may be used to indicate the control is not being used and the machine may be configured in an E-stop condition. A 2-4 oz force may be used to indicate operator presence. A 4 oz-15 lb force may be used to indicate that the set can proceed at full output capacity. And anything greater and 15 lb input force may be used to create an E-stop state. A Person of Ordinary Skill in the Art will recognize that inputs and gestures can be mapped in many ways without departing from the scope of the present disclosure and the preceding scheme is only exemplary.

Figure 11:
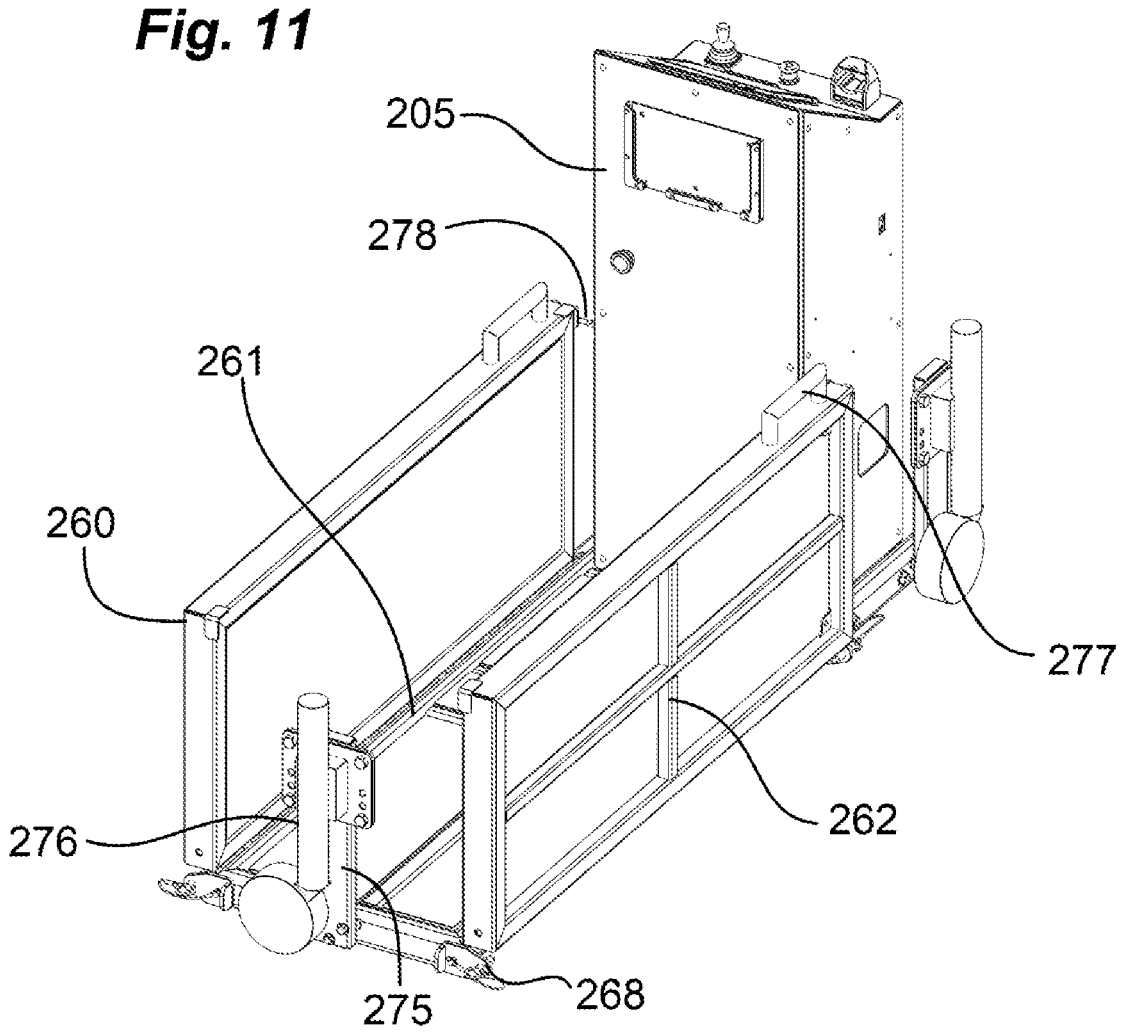
FIG. 11 is a perspective view of a second embodiment of the present invention, configured for transportation.

With particular reference to FIG. 11, the utility of the segmented platform (if provided) is illustrated. As shown in FIG. 11, the foldable wing segments 260 and 262 may be folded upward using handles 277 and attached to the control tower 205 through the use of hasps 278. The mobility of an embodiment of the present invention may be enhanced by adding a transport system with at least one wheel that is removably mounted to the platform. For example, three jack-stands 276 of ordinary design may be mounted to lifting brackets 275, which are bolted to portions of the center platform panel 261. Jack-stands 276 may be used to lift the single-pulley machine, at which point it may be rolled around for easy mobility. Foldable wing segments 260 and 262 of the platform portion 204 allow the entire machine to become narrow enough to fit through a 36 in wide opening. Jack-stands 276 may be used in a similar fashion to adding a mobility enhancement to the first embodiment as well. Alternatively, as will be shown subsequently, the jack-stands can be replaced with kick-lift casters. As a further alternative, wheels may be permanently attached to the machine apparatus. A person of ordinary skill in the art will recognize that many possibilities exist.

Figure 12:
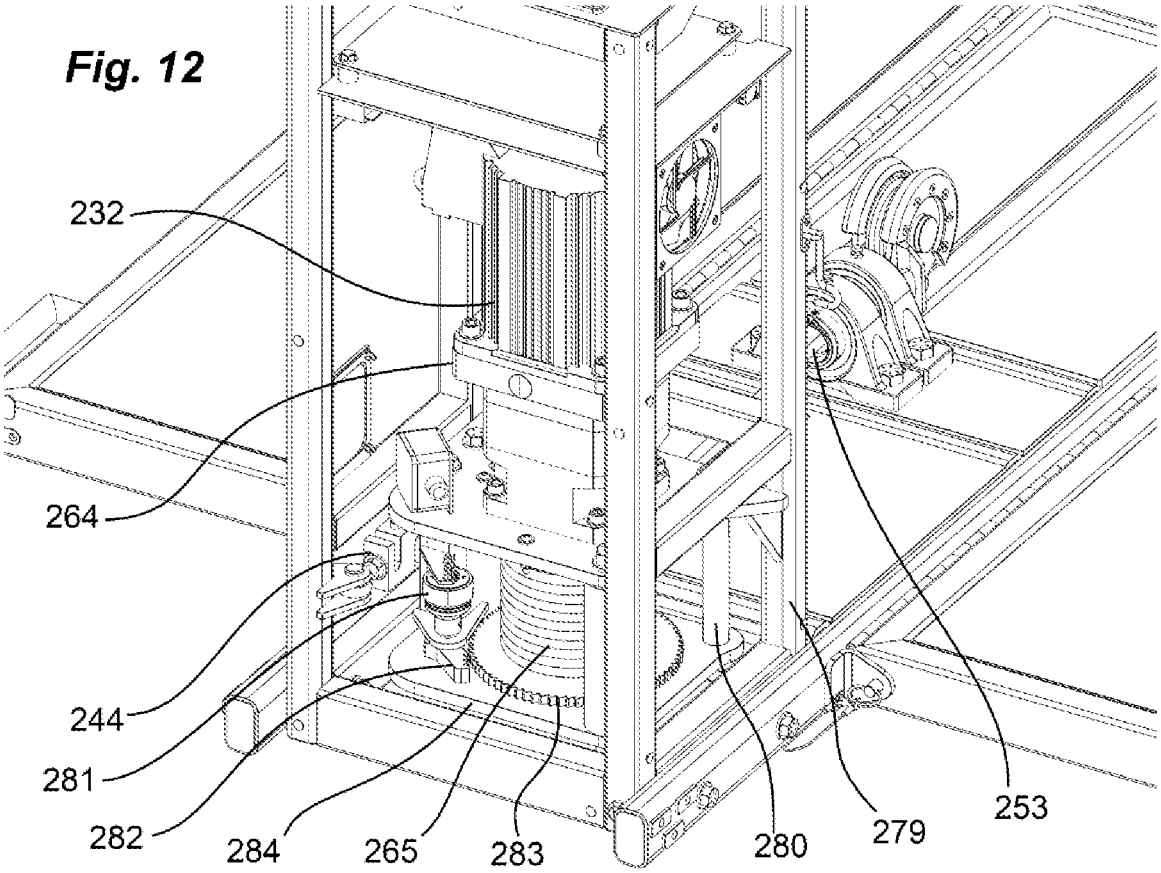
FIG. 12 is a perspective view showing the drive system of a second embodiment of the present invention.

With particular reference to FIG. 12, a detailed view of the drive system of the second embodiment is shown. The drive system comprises the servo motor 232, the gearbox 264, the winch drum 265, and the drive block frame 284. The drive block frame 284 is pivotally attached to the control tower frame 279 at a pivoting pin 280. A force measurement device such as a load cell 244, is provided, which is connected on one side to the drive block frame 284 and on the other side to the control tower frame 279. This arrangement creates a relationship between a force exerted on winch line 253 and a force seen on load cell 244, thereby allowing the user input force to be measured. A locking plate 283 may be provided with locking pawl 282 operated by an actuator 281 such as a rotary actuator or rotary solenoid. When the rotary actuator 281 is activated, it moves the locking pawl 282 towards the locking plate 283 thereby allowing a force to be supported on extension line 253 without the continuous activation of servo motor 232. This enhancement provides several advantages in that it allows the single-pulley machine to continue to support loads in the event the servo motor 232 overheats. It also allows the single pulley machine to support greater loads mechanically than the servo motor 232 may be otherwise capable of generating, thereby allowing for high forces with a lower cost servo motor 232. This locking system may also be implemented on a machine such as the first embodiment machine 100.

Figure 13:
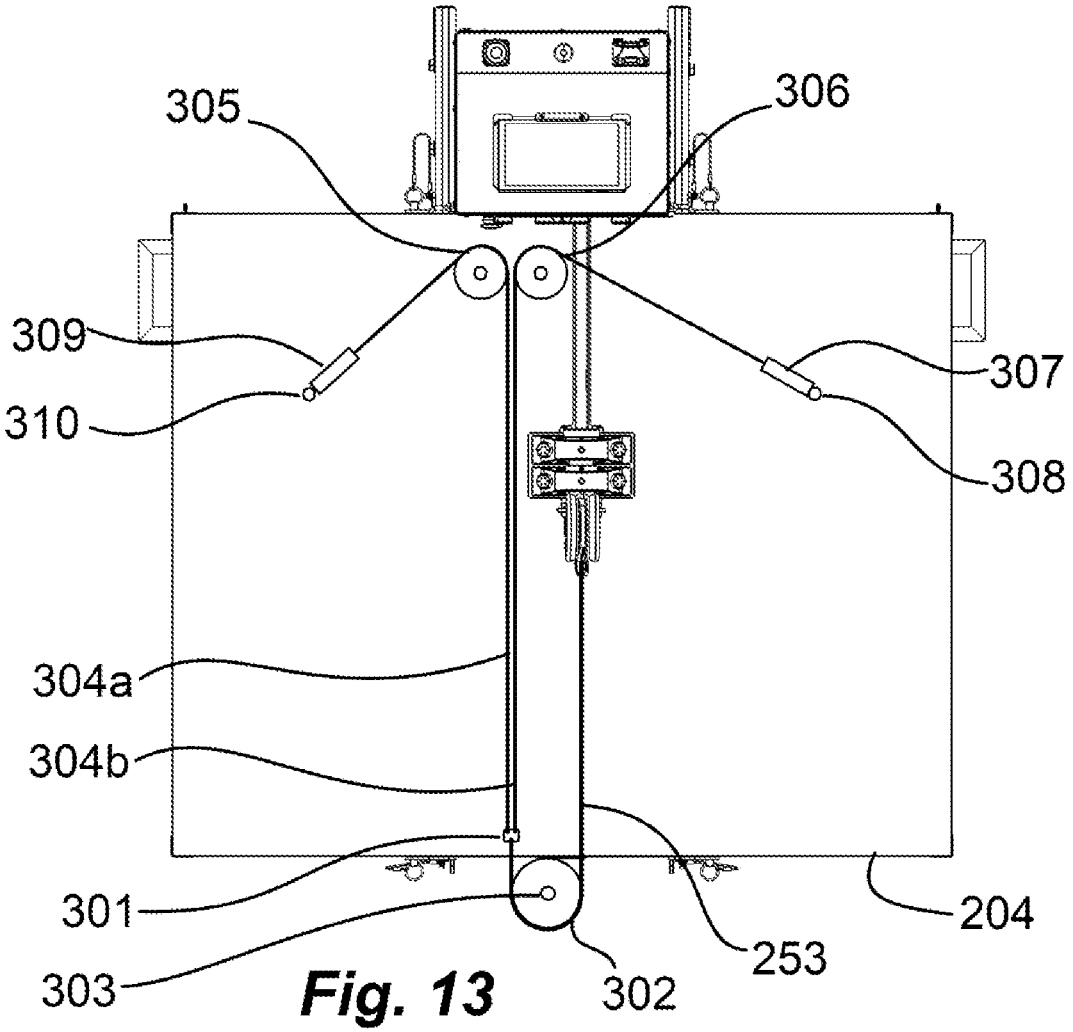
FIG. 13 is an aerial view of a second embodiment of the present invention that shows an optional attachment for two pull-locations to be added to a single pull location.
Figure 14:
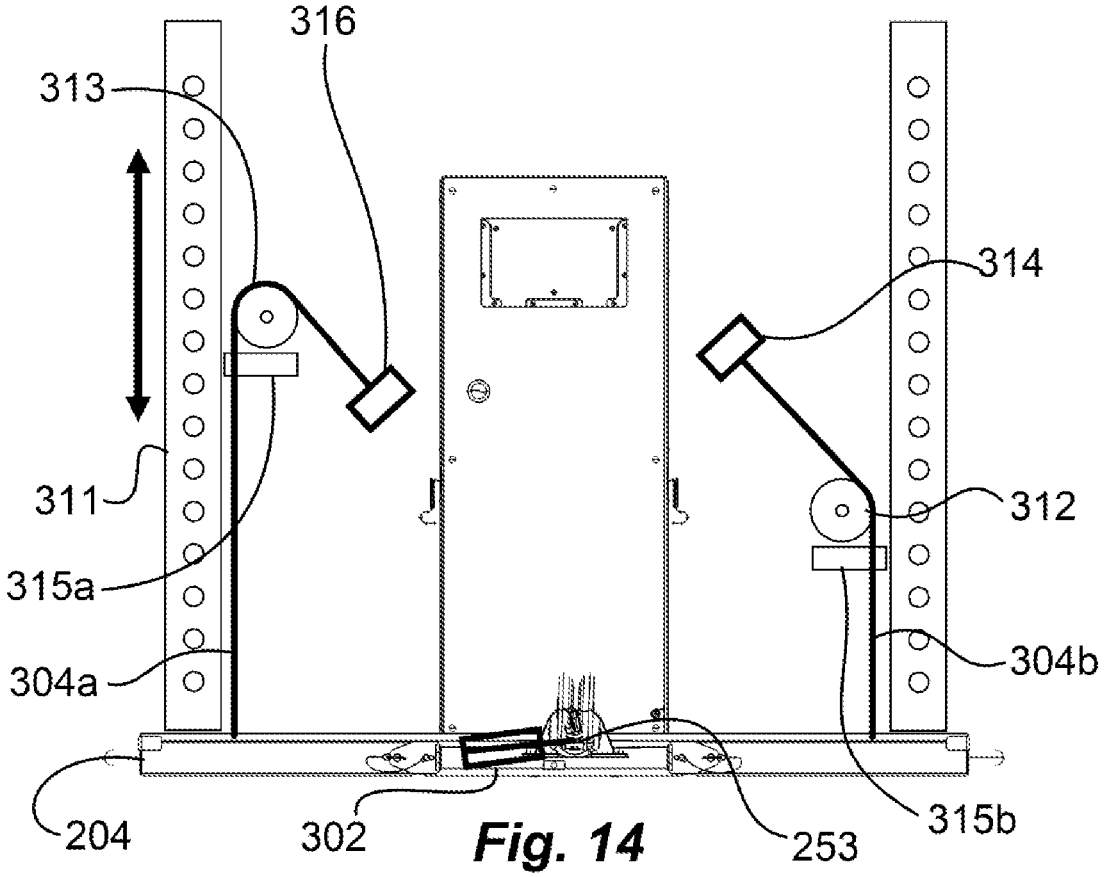
FIG. 14 is a front view of a second embodiment of the present invention with an enhancement that allows two pull-locations to be added to a single pull location.

Additional enhancements and embodiments are also contemplated. For instance, an electromechanical exercise machine, according to the present invention, may be constructed with one or more pull locations. Embodiments with a single pull location and three pull locations have been described in detail. However, a two pull-location embodiment may also be constructed in various ways. For example, the center pull location of the three-pulley machine may be eliminated, thereby providing a two pull-location machine. Additional pull locations may be added through the use of external accessories or external structures. For example, an external pulley system may be added to the single-pulley machine 200 such that it provides the option and versatility of being used with two pull locations. Many possibilities exist; for instance, FIGS. 13 and 14 show one such possibility. Rope or cord 253 of the second embodiment may be extended out and around an externally mounted pulley 302, which may be mounted below the surface of the platform 204. The external pulley 302 may be equipped with a proximity sensor on pin 303, which disables the use of a single user mode for increased safety when two-pull locations are available. After running around an external pulley 302, rope 253 may terminate at a coupling 301 which is attached to two smaller ropes, 304*a* and 304*b*. Rope 304*a* may pass around pulley 305 and 309 before exiting at an external pull location 310. Similarly, rope 304*b* may pass around pulleys 306 and 307 before exiting at a pull location 308. One of ordinary skill in the art will recognize that the arrangement of FIG. 13 allows a single-pulley machine to be adapted for use as a two-pulley machine. As shown in FIG. 14 optional tower accessories 311 may be installed on platform section 204, which provide variable vertical positioning of pull locations 314, 316. If towers such as these are incorporated with a three pull location design (as will be shown subsequently) this will result in a five pull location machine. Optionally, a pullup bar of ordinary design (not shown) may be installed between tower accessories 311. As shown in FIG. 14, ropes 304*a* and 304*b* of FIG. 13 exit platform section 204 in an upward direction. Rope 304*a* may pass around pulley 313 and terminate at an attachment 316 (shown as a handle) of any desired type. Pulley 313 is slidably connected to a tower 311 via a safety rail 315*a*. As a matter of further enhancement of safety, rope 304*a* may pass through the safety rail 315*a*, thereby ensuring that the safety rail must be used in this configuration. In a similar manner, rope 304*b* may pass through safety rail 315*b*, around pulley 312, and terminate at attachment 314. One of ordinary skill in the art will recognize the advantages of the arrangement of FIG. 14 in that it provides extensive versatility in the types of exercises that can be performed. Optionally, a more complex arrangement of pulleys may be implemented with the tower accessories shown in FIG. 14 such that a constant length of rope is required regardless of the vertical positioning of the safety rails 315*a* and 315*b*, such as is well-known in the art.

One of ordinary skill in the art will recognize the utility and versatility of the exercise methods that can be accomplished using the apparatus disclosed above. The apparatus fills a long-felt need for a displacement-based exercise machine that is low-cost and provides variability and customization on a per-repetition basis. A displacement-based exercise machine allows for maximum force potential to be developed by a user at every point of every repetition, especially on the eccentric phase of a repetition where a user's force potential is highest. Further, displacement-based exercise allows significantly greater flexibility on each repetition as compared with simple isokinetic exercise. Specifically, displacement-based exercise with a hold-to-operate control by either the user or the coach allows for pauses (where isometric portions may be inserted) as well as reversals mid rep (which may be centered around peak kinematic potential). These sorts of elements may be efficiently and easily inserted into any rep at any time in a set that also allows full utilization and exercise through the full range of motion.

Figure 15:
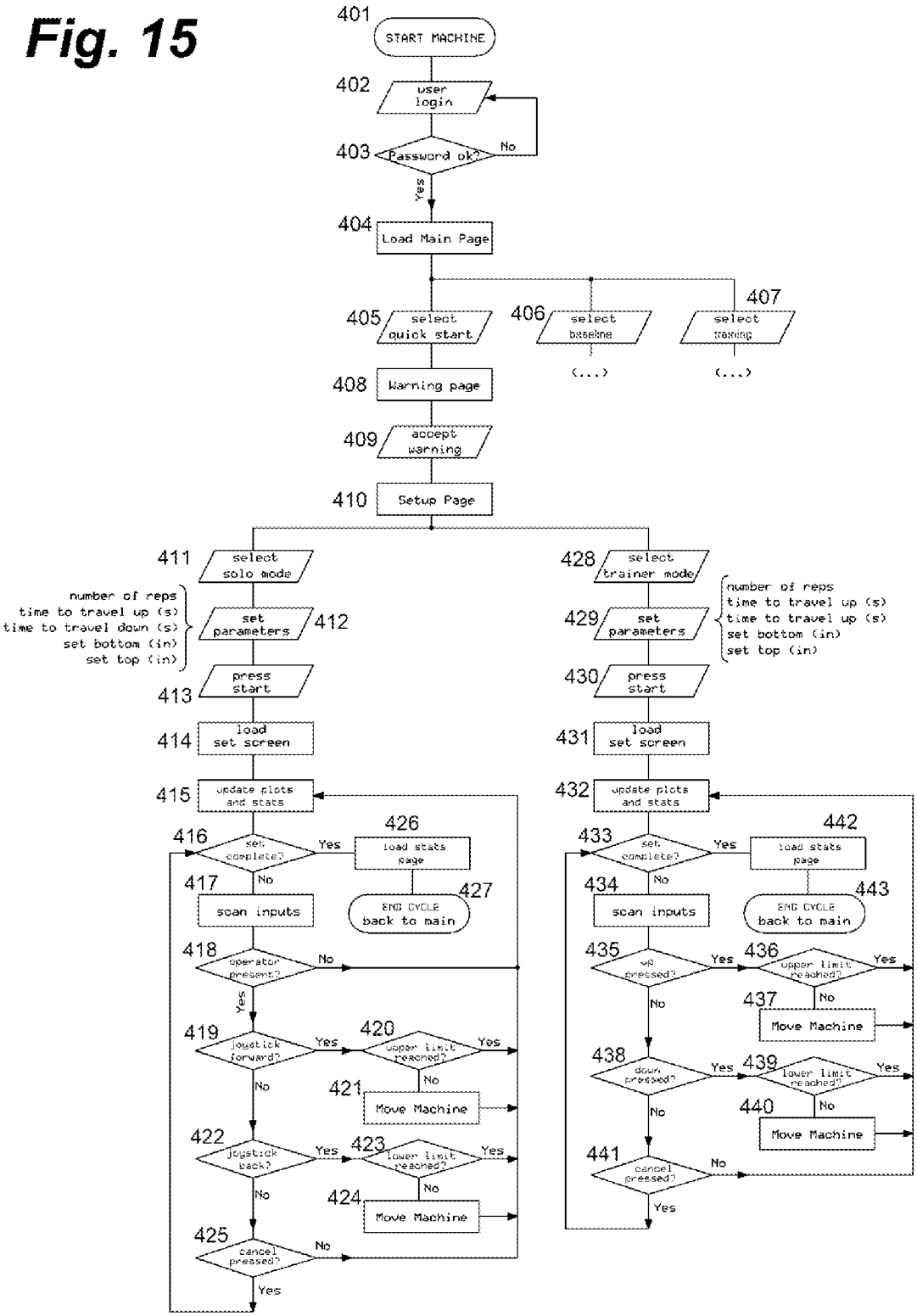
FIG. 15 is a flowchart describing one embodiment of a software system that may be used to control a machine according to the present invention.

A software system may accompany the apparatus previously disclosed to further enhance the versatility and safety of the machine. FIG. 15 shows a flowchart that demonstrates one possible way software can be used to accompany the apparatus disclosed above. As shown in FIG. 15, any of the embodiments disclosed, or other variations which do not depart from the present invention may be configured to be operable through the use of a software-based graphical user interface, mediated, for instance, through a touchscreen or the like. After the present machine is turned on ("Start Machine" 401), an additional layer of safety may be implemented through the use of a user login 402. In this way, the use of the machine may be limited to those who have been trained in proper and safe use. As shown, the interface may be configured such that it will check the login credentials against a known set of credentials (as in 403) and only proceed to load the main page 404 once a user provides valid credentials. The credentials may be a password only but may also have a username and password. A username and password requirement or the use of different passwords for different users can provide further functionality in that alternative operational modes can be associated with different credentials. For example, a normal use mode may be provided in contrast to an admin mode.

Once at the Main Page 404, a user may select from one or more modes of operation. As shown in FIG. 15, a "quick start," 405 "baseline," 406, and a "training" 407 modes are provided. A "quick start" mode, if provided, may be configured to permit a user to perform exercises quickly but without a specific training benchmark of any kind or without recording of data or being associated with any specific exercise. In contrast, a "baseline" training mode 406 may be provided, which may read a "1 rep max" (an athlete's maximum capacity for a single repetition) for a specific exercise performed by a specific athlete. A data storage system may be provided to recall or export collected baseline data for further use and analysis. As yet another mode of operation, a "training" mode 407, if provided, may be configured to allow a user to train relative to their baseline or "1 rep max" for a specific exercise. For example, a user may wish to train at perhaps 70% of their "1 rep max." To accomplish this, a training mode may be provided which allows a user to select the previously recorded "1 rep max" data for a specific exercise performed by a specific athlete and scale the recorded data to 70% (optionally +/− some tolerance band to create a target channel). Data collected during a "training" mode may also be stored and recalled or exported for further use and analysis. For instance, historical data may be used to determine how much progress an athlete has made in a certain amount of time. It may also be used to determine if progress has plateaued for any reason and thereby assist with a diagnostics process. In any operational mode, force and displacement data may be displayed visually to an athlete (for instance, on a plot) as it is being collected in real-time. When recalled from previous training sessions (for instance, during training), a previous exercise plot may be loaded and displayed (or a scaled version of it), and, newly collected data may be plotted over the top of it in real-time such that an athlete may visually adjust their effort relative to their previously recorded "1 rep max." This may help an athlete, for instance, to pace their effort so as to produce greater exercise volume. Additional modes of operation are possible. For instance, other modes of operation are contemplated, which may simulate weight-based exercise but where the weight may change depending on position, direction, speed. In this way, greater flexibility may be achieved with the exercise and operation of the present invention. Functionally there is a great deal of similarity between the three operational modes highlighted. Supposing that a user selects the "quick start" mode of operation, the system may be configured to present a warning page 408, which brings some of the hazards of exercise and displacement-based exercise specifically to the user's attention. As is a typical practice, an exercise machine is provided with warning decals to alert the user to hazards and encourage them to use the machine safely. However, it is well-known that a user may not always read or fully comprehend a warning decal prior to use. Further, a user may not be particularly safety conscious. As an additional layer of safety associated with the present invention, a warning decal or simple instruction may be presented to the user before enabling any movement thereof. The user may be required to press a button in a user interface to "accept" 409 that they understand the dangers of exercise and specifically with displacement-based exercise. This makes it more likely that a user will see and understand the warning information.

After accepting a warning 409, the system may be configured to load a setup page 410, which allows a user to input desired parameters for the specific exercise they wish to perform. For example, a user may be performing a workout with a coach, in which case they would press select the "trainer mode" 428, which signals to the system to enable the tower controls and keep the single user controls disabled once the workout starts. Alternatively, they may select the "solo" or "single-user" mode 411, in which case the control tower controls will be disabled, and the single user control will be enabled during the set. From here, a user may input various set parameters 412, 429. For instance, the set may be defined by a number of reps, a time to travel up/down, and a top/bottom position to stop at. Set parameters may be different between a single user mode 411 and a trainer mode 428. For instance, if the present invention is configured to auto-move during a set, additional set parameters may be provided for single-user modes, such as a start delay (in seconds), an isometric pause at the top/bottom (in seconds) and other parameters as necessary. While a time up/down may be selected, the motor can only go, so fast so the possibility exists that a user could select a time up/down that the machine can't keep up with. As an alternative, a travel speed up/down may be provided as an input that is limited to the capability of the motor.

As an additional layer of safety, the present invention may be configured to require a user to set a top and a bottom position prior to performing a set. As a user is unlikely to know to the inch where the top and bottom positions should be for a given exercise, the machine may be configured to measure it for a user. This may be done by enabling the controls of the machine to be used with a low force limitation to allow a user to move the machine to the top and press a "top" button in the user interface, and then move the machine to the bottom and press a "bottom" button in the user interface. This provides an additional layer of safety because this information may be used to restrict the movement of the machine to the range of motion a user is capable of safely moving through. Thereby it prevents hyperextension and attempted machine travel to dangerous locations. For instance, if a user is performing a bench press, this setup process will require them to set the bottom above their chest. By setting the bottom in this way, the machine movement may be limited, thereby never attempting to move to a position below the user's chest which may be dangerous. In this way, movement of the machine may be stopped regardless of continued user input. Additionally, movement limit thresholds as described serve to provide a very consistent range of motion from repetition to repetition. Alternatively, the bottom and top positions may be measured automatically by moving the machine in direct response to tensile input from the user, simulating, for instance, the performance of a tape measure tool of ordinary design. The machine may seek to draw in under minimal tension, which can easily be supported by a user. If tensile input from a user exceeds a small threshold, the machine may allow the ropes to extend. In this way, the position of a user may be tracked by the machine in real-time. Once positioned in one of the extremes, a user or coach may press an input such as the "top" or "bottom" button in the user interface to signal to the machine that the current position should be treated as the top or bottom of a repetition. During the top/bottom measurement process, the machine output force may be limited to a safe value. The machine may be configured to disable starting a set until all parameters have been set.

Once all the input parameters are set, a user may press a "start" button 413, 430 to begin an exercise cycle. Once an exercise cycle has been started, user controls (either the control tower or the single-user controls) may be enabled such that by manipulating them, a user (either a trainer or an athlete) can cause the machine to move depending on the machine mode. The machine may be configured to load a set screen 414, 431, which may display current set information as desired. For example, a set screen 414, 431 may be configured to display a real-time plot of position and force as a graphical element. Further, a set screen can be configured to display running statistics such as set time, total work/volume, peak force output, and other parameters as desired. As shown in FIG. 14, the set may be run as a repeating loop type structure in which the machine continuously cycles through scanning inputs 417, 434, responding to inputs, and updating an output display 415, 432. In this manner, within the capability of the machine, all display and machine response will be continuously up-to-date. Such a continuous loop structure is well known in programming, and a person of ordinary skill in the art would readily understand that a loop-type structure may take different forms and sequences while accomplishing the same objective, namely keeping inputs and outputs up-to-date. As an additional alternative, an event-based programmatic structure may be used in which rather than continuously cycling through inputs/outputs, event listeners may trigger the system to respond to individual inputs as necessary. This approach has the advantage of reducing computing power demand. Many types of programmatic control may be implemented. The control-loop type structure disclosed in FIG. 14 is only exemplary in nature but may, for instance, begin with updating output plots and stats 415, 432 with the most current information. If the user interface is configured to plot force and displacement, for instance, on a common X-Y plot, this step will cause the current data point to be added to the plot. Alternatively, current force information may be displayed, for instance, as a bar or column chart, simple text numerical display, or more artistically as a dial indicator such as a scale. Many variations are possible. However, regardless of which display method is implemented, this step will keep this output updated. After completing this step, the machine may be configured to check if a set is completed 416, 433. While this step will never return a YES output on the first iteration of the loop, as the machine is continuously performing this step, it will keep the information display up-to-date. The set may be configured to be complete (in which case this would return a YES output) in multiple ways, two of which are disclosed in FIG. 14. First, a set may be completed when the machine has moved through the set range of motion the set number of times (reps). At this point, the user will have completed the amount of work that they entered into the machine before beginning their set. Alternatively, a cancel/abort option 425, 441 may be provided, which would allow a user to skip reps and automatically end a set if necessary. For instance, depending on user output, they may reach the desired level of muscle fatigue sooner than anticipated or may have realized that they want to change some of the input parameters on a new set. A back button may be provided at every point in the sequence, thereby allowing easier navigation of the user interface as well. If a set is determined to be complete, the machine may be configured to exit the set control loop and load a "stats" page 426, 442. The stats page may display various parameters of interest for the set, including peak force, total volume, etc., for an athlete and/or coach to review. Once done reviewing the final set data, the user may choose to end the set cycle and go back to the main screen 427, 443.

If the set is not determined to be complete yet, the next step in the control loop may be to scan the inputs 417, 434, consisting of the user controls, the load cell, and the encoder. By continuously performing this step, the machine is able to continuously keep up-to-date with the inputs and respond accordingly. Consequently, the next steps in the control-loop consist of making decisions based on these inputs. For instance, with the trainer mode, the machine may be configured to check the state of the operator presence sensor 418 first. This provides an additional layer of safety as unless the operator is present, no other machine movement will occur. As the single user controls may be configured to rely on redundant self-checking hold-to-operate buttons, no operator presence sensor may need to be checked when using this mode. Next, the position of the joystick or single user control buttons may be responded to. If the joystick is pressed forward 419 or the up button is pressed on the single-user control 435 (depending on which control set is enabled), the machine may be configured to check to see if it at or past the upper limit 420, 436, in which case it will not move any further despite the user input to the contrary. Instead, it will cycle back to the top of the control loop. If, however, the machine is not at or past its upper limit, this would be determined to be a valid input from a user, and the machine will move in the direction indicated by the user 421, 437. In the same way, if the joystick is pulled back 422 or the down button is pressed 438 the machine may test to see if it is at or below the lower limit 423, 439. If it is, then no movement will occur, and the loop will be restarted. If it is not, then the machine may be configured to move in the indicated direction 424, 440.

It will be apparent to a person of ordinary skill in the art that the present system may be used to safely implement displacement-based exercise. As shown in FIG. 15, a hold-to-operate control style may be implemented to provide maximum safety and exercise versatility. Other modalities of control may be implemented. For instance, instead of a hold-to-operate control, the machine may be configured to move between extremes automatically, without requiring continuous user input. In this case, as long as the user does not change position between setting the top and bottom and completing the set, they can remain safe for the duration of a set and have the added convenience of having the machine move automatically through the set. Various pre-programmed movement patterns (including pauses and/or reversals) may be implemented.

Many other software-based or hardware-based features may be implemented to provide further enhancements to the functionality of an electromechanical exercise machine, according to the present invention. For instance, the electronic display and control system may be configured to be able to broadcast or otherwise propagate its display on a secondary screen of arbitrary size. For instance, accompanying the embodiment of the three-pulley machine, a secondary screen may be connected and configured to display set data while a user is performing a set. This direct visual feedback can help the user to know how hard to push and thereby help muscular development take place faster. A similar setup may be used for the embodiment of the single pulley machine. As an additional utility, a secondary screen may be prominently displayed such that individuals other than the coach or user may see the progress of an exercise. In this way, such a screen may be utilized for marketing purposes.

As yet another software-based enhancement, if a baseline or training mode is provided as previously disclosed, a machine according to the present invention may be configured to store data locally as well as remotely such that a user may be able to use any number of machines in the same gym or abroad and load their data. This data may optionally be tied to a specific profile in a manner as is well-known. An external interface through an internet connection may also be provided where a user may see additional analysis of their data and download or export their data for further use.

Yet another enhancement contemplated by the present disclosure is the capability through programmatic control to compensate for the change in length of a rope. This has the advantage of providing means whereby greater variety in rope materials may be accommodated. It is well known that steel cable is commonly used in exercise equipment. In typical weight-based exercise equipment, the loading is only a few hundred pounds at most (typically) and so the steel cable required to support that load may be small. However, when higher loads are used, such as may be used in an embodiment of the present invention with a significantly higher force capability the size of the steel cable and therefore associated pulleys may become prohibitively large. Larger steel cables are also known to have reduced flexibility and therefore tend to require large pulleys to maintain appropriate minimum bend radii. This may pose a significant design challenge as the components to place and guard become larger. However, fiber ropes are well-known to provide significantly improved flexibility over steel cable as well as very high strength-to-weight ratios. Further, fiber ropes are not prone to create significant recoil hazards in the case of a cable failure as steel cables are. Fiber ropes may therefore be used to support very large loads safely while allowing much smaller pulleys to be used. However, many fiber ropes are liable to change length under tension due to a tightening of the rope lay and/or elastic stretch. This can cause problems when the top and bottom limits of a set are determined at low tension, and the exercise is performed at high tension. In order to correct for this, fiber ropes that are not prone to lengthening may be used, or software-based compensation strategies may be employed. By modeling the length/tension curve for the rope, the output of the machine can be adjusted to provide the simulation of a completely inextensible rope. This software-based compensation, if provided, needs to be consistent with the structural layout of the machine it is used with. For instance, the compensation routine for the first embodiment 100 according to the present invention will necessarily have to be different than the compensation routine for the second embodiment 200 according to the present invention.

Figure 16:
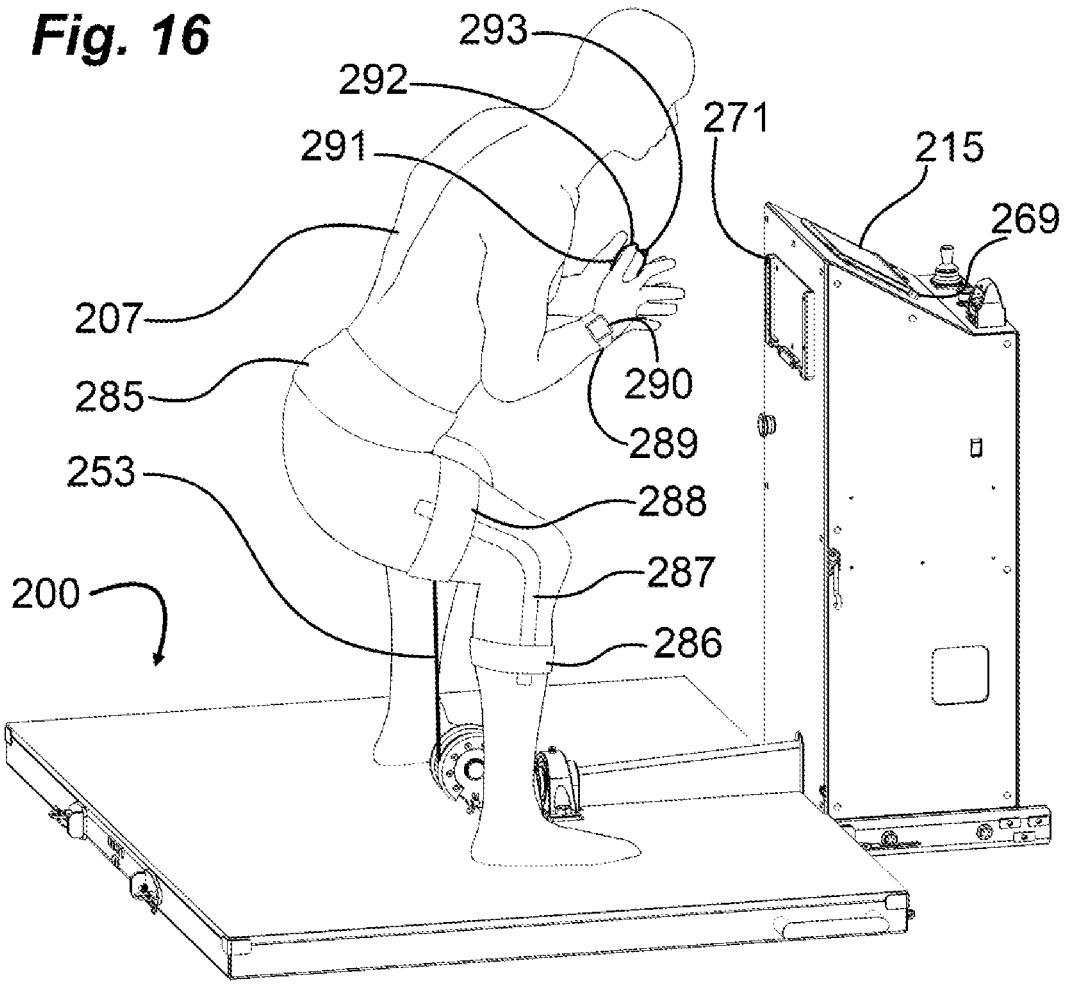
FIG. 16 is a perspective view showing an athlete performing a squat on a second embodiment of the present invention.

Several further enhancements in terms of instrumentation and control are also contemplated. Referring specifically to FIG. 16, a user 207 is depicted as performing a squat on a single-pulley machine 200. This squat exercise is facilitated through the use of a belt 285 (which may be a dips belt) attached to a rope 253 which can be extended from or retracted into machine 200. User 207 can exert their entire mechanical capacity against rope 253 through every repetition of every set of squats. A hand-held remote 291 is provided with one or more buttons 292 and 293 which a user may use to control machine 200 without the need for a coach. As a first operational enhancement, user 207 may wear a flexion sensor 287, shown for examples as attached by straps 286 and 288. Flexion sensor 287 may be configured for example as a strain-gauge type sensor which may be used to measure knee joint articulation. Data collected from flexion sensor 287 may be collected (wirelessly or through a hard data line) by machine 200 and plotted along side other data for use in calculating performance metrics. Flexion sensor 287 may be used to provide additional safety in that a warning may be issued by the machine 200 if joint articulation reaches an unsafe position. Flexion sensor 287 may also be used to improve consistency on every repetition as well as to gauge muscle action and balance. Depending on the posture and movement of user 207, a squat may be used to focus on the quadriceps muscle or the glutes. Flexion sensor 207 may be adapted to measure the balance between cooperating muscle groups. Optionally, multiple flexion sensors 207 may be used simultaneously thereby providing additional insight. Flexion sensors such as 270 may optionally be adapted for use on a hand of user 207 whereby user gestures may be interpreted and used to send commands to machine 200. As a further enhancement, a biometrics measuring device 290 attached to a wristband 289 may be provided which may be configured to measure athletic performance metrics such as heartrate, skin conductivity, joint articulation, etc. Data generated by such a measurement device may also be collected by machine 200 and use for informational display and calculations of various performance metrics. Biometrics measuring device 290 may also be configured to send commands to machine 200 in place of a remote 291. As yet a further enhancement, machine 200 may be equipped with a microphone, and may be configured to accept and interpret voice commands from user 207, thereby negating the need for a remote 291. As a further enhancement consistent with the present invention, machine 200 may be provided with a touchscreen 215 which may be placed in a charging station 269 or a front-facing charging station 271. The software system of machine 200 may be configured to display passive or interactive training assistance content on touchscreen 215 which may be visible to user 207 when it is placed in front-facing charging station 271 (or any location where the touchscreen 215 faces user 207). This content may include, for instance, videos of personal trainers performing exercises and/or workouts, motivational feedback in the form of audio (music, speech) and visual elements (points, awards, banners, and the like). In addition to these features, a mobile app may optionally be provided which allows users to see and track their personal progress.

Figure 17:
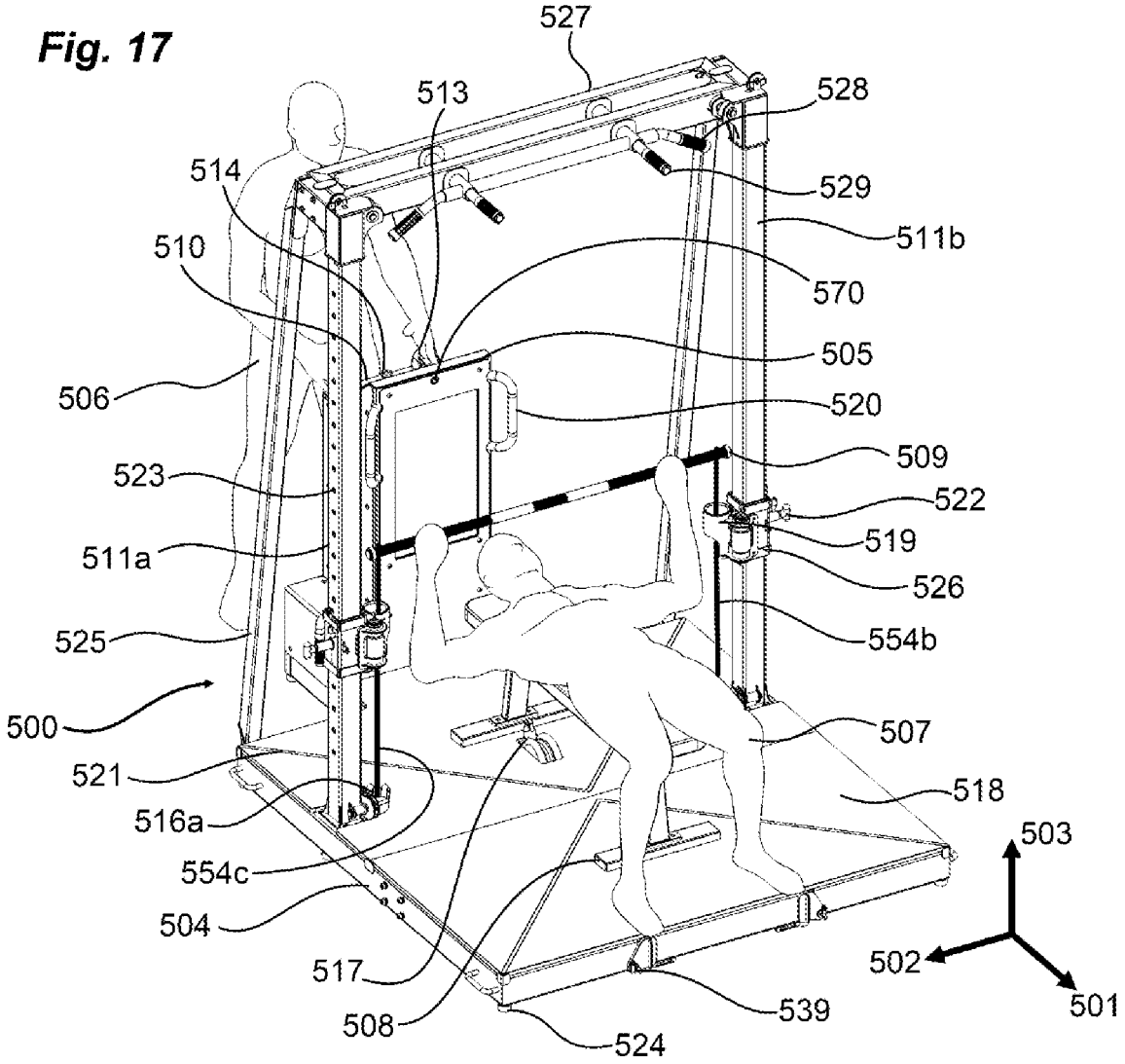
FIG. 17 is a perspective view of a third and preferred embodiment of the present invention.
Figure 18:
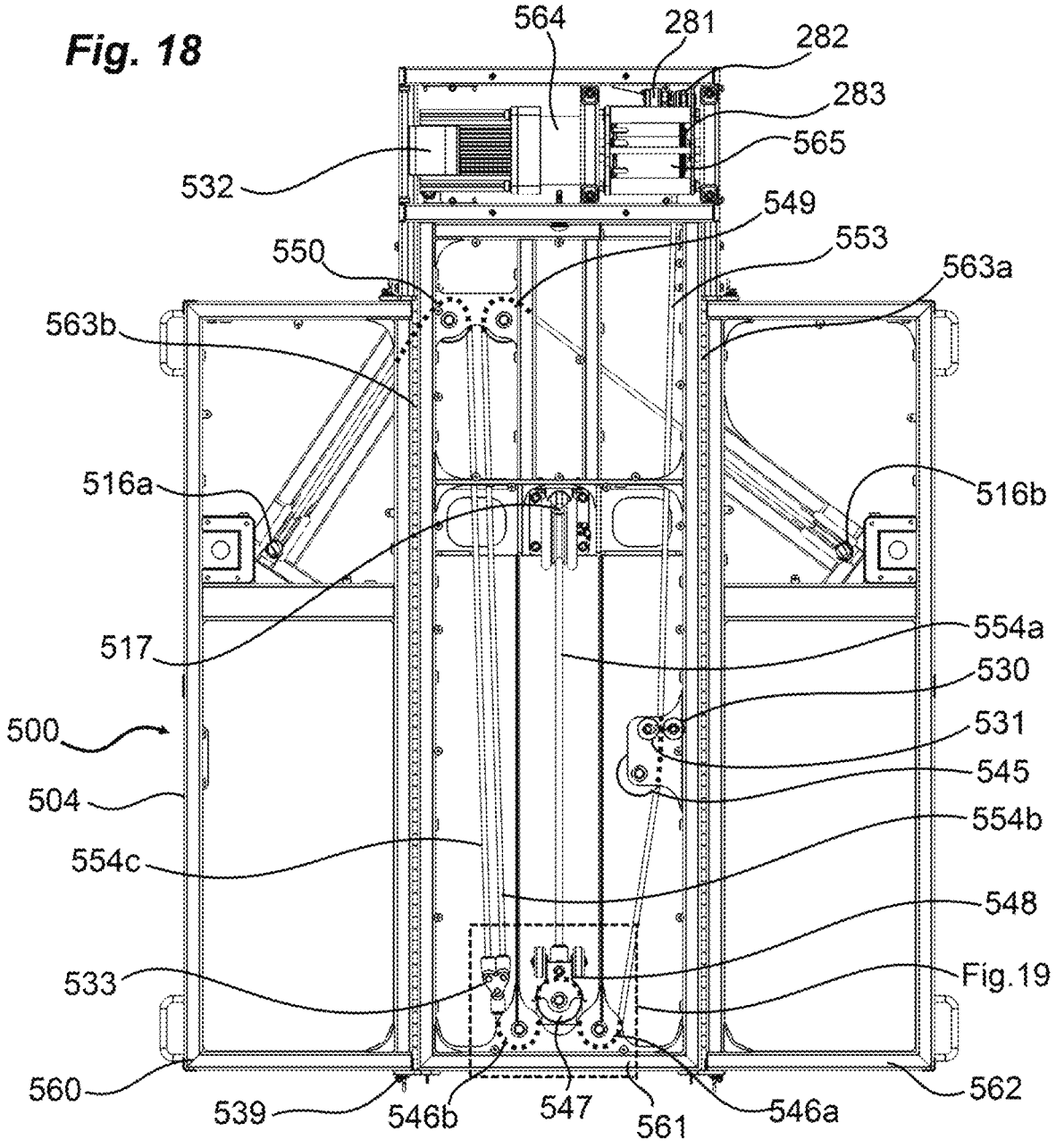
FIG. 18 is an overhead view showing the internal arrangement of components of a third embodiment of the present invention.

With reference to FIGS. 17 and 18, a third and preferred embodiment is shown in a perspective view. In particular, a three-pulley machine 500 is shown in the context of a longitudinal direction 501, a transverse direction 502, and a vertical direction 503. The machine 500 comprises a platform portion 504 and a control tower portion 505 and may be used by an user 507 working alone or in conjunction with a coach 506. The machine 500 is generally supported on a set of feet 524. As shown in FIG. 17, user 507 is performing a bench press exercise using a barbell 509 being pulled on by tension supporting members, in this case, ropes 554*b* and 554*c*. The machine 500 is provided with at least three pull locations comprising two outer pull locations 516*a* and 516*b* as well as a center pull location 517. The machine 500 may comprise an athletic surface 518 such as a rubberized floor which may include a pattern or design 521 for aesthetic purposes. As shown in FIG. 17, machine 500 may be provided with posts 511*a* and 511*b*. Posts 511 are supported by rear braces 525 as well as pull-up bar portion 527. Optionally, the pull-up bar portion 527 may be provided with wide grip handles 528 and hammer grip handles 529 or any other common bar pattern used for pull ups. User 507 may use pull-up bar 527 by itself or in conjunction with machine 500. Collars portions 526 slidably engage with posts 511 and may be selectively locked at varying heights through the use of locking pins 522 which engage with corresponding holes 523 in the posts 511. Collars 526 may mount support cups 519, which have a channel or passage for the tension supporting member to pass through. In use, a user 507 may perform many exercises using machine 500 including a bench-press exercise as shown in FIG. 17. When performing a bench-press exercise, support cups 519 must be set at a proper height above the chest of user 507 and securely locked in place using pins 522. Rope portions 554*b* and 554*c* pass through respective support cups 519 towards barbell 509. Thus, in use, machine 500 may only pull barbell 509 downward toward user 507 until it engages with support cups 519 which are provided with adequate structural capacity to support the full pulling capacity of machine 500. A person of ordinary skill in the art will recognize that this arrangement provides a safe manner in which a user 507 may perform high capacity bench-press exercises without risk of serious injury. Machine 500 may be used without posts 511*a* and 511*b* for various exercises as well including squats. During a squats exercise for instance, user 507 may stand over center pull location 517 in a manner similar to what is depicted in FIG. 16 and may optionally grasp handles 520 for added lateral support during a squats exercise.

With particular reference to FIG. 18, the internal arrangement of the machine 500 is shown. A person of ordinary skill in the art will recognize that many different types of actuators may be provided to run machine 500, however, machine 500 is shown utilizing a winch system, similar to what is shown in FIG. 12. This winch system includes a winch drum 565 (under retaining covers), a servo motor 532 and a gearbox 564. This winch system is mounted in a horizontal orientation such that the rotational axis is parallel with the transverse axis as opposed to the winch system shown in FIG. 12 which is oriented parallel to the vertical axis. A Person of Ordinary Skill in the Art will recognize the advantage afforded by this horizontal orientation which allows for the position and angle of the winch rope 553 coming off of the winch drum 565 to be accommodated internal to the platform portion 504 of machine 500. Force measurement may be accomplished through the use of a force measurement device such as a load cell similar to what is shown in FIG. 12 or through the use of torque sensing instrumentation associated with servo motor 532. While servo motors such as 532 are typically provided with position measurement devices such as encoders which allow them to keep track of their position, the output pulleys 516*a*, 516*b*, and 517 may be provided with encoders or equivalent hardware which allow the machine to determine which output pulley(s) are being used currently to calculate the appropriate mechanical advantage and thereby measure the correct force applied by the user. Position measurement devices may take multiple different forms including draw wire sensors, potentiometers, encoders, ultrasonic distance sensors, laser distance sensors, and many other devices known in instrumentation. As shown in FIG. 18, winch rope 553 extends from drum 565 to a first pulley 545 passing through rollers 530 and 531 which are urged together by elastic means thereby softly grasping rope 553. Rollers 530 and 531 may be provided with sleeve type bearing surfaces which provide a small amount of drag which provides a small amount of tension on rope 553 as it is being wound onto drum 565. In this way, rollers 530 and 531 along with the associated elastic element form an auto-tensioning element which assists with proper winding in addition to other features which will be discussed in greater detail. From the first pulley 545, rope 553 extends around a second pulley 546*a*, a horizontal runner pulley 547 which is on a horizontal runner block 548. From there it passes around fourth pulley 546*b* to a 2:1 splitter coupling 533. Horizontal runner 548 has a first output rope segment 554*a* which travels to the center pull location 517. 2:1 splitter coupling 533 has a second output rope segment 554*b* and a third output rope segment 554*c* which pass around pulleys 549 and 550 respectively to outer pull locations 516*a* and 516*b* respectively. A Person of Ordinary Skill in the Art will recognize the advantages afforded by the arrangement shown in FIG. 18. For example, machine 500 may be used for many different exercises including bench press and squats. It is well known that squats or deadlifts are the exercises that allow a user to generate their maximum force potential. On machine 500, squats and deadlifts would be performed using center pull location 517. In contrast to this, an exercise with lower force generating potential such as bench press will be carried out using the outer pull locations 516*a* and 516*b* as shown in FIG. 17. The arrangement of ropes segments is matched to the strength characteristics of a human in terms of force capacity and speeds. Whereas the servo motor 532 need only be capable of generating sufficient force for the bench press exercise, the horizontal runner has a 2:1 mechanical advantage due to the rope 553 passing over the pulley 547. Thus, a smaller servo motor can be used along with smaller rope in the machine which require smaller pulleys and less steel structure. Only a small segment of high-tension rope is required between the horizontal runner 548 and the center output pulley 517. Similar to the single pulley machine shown in FIG. 11, platform portion 504 of machine 500 may be divided into segments 560, 561, and 562 to permit easier transportation. Segment 560 is shown hinged to center segment 561 through hinge 563*b* while segment 562 is shown hinged to center segment 561 through hinge 563*a*. Wing segments 560 and 562 may be locked in orientation relative to center segment 561 through the use of locking pins 539. The third embodiment of the present invention may be configured for transportation by removing the posts 511 (if provided), removing the locking pins 539 and folding up the wing segments 560 and 562.

Figure 19:
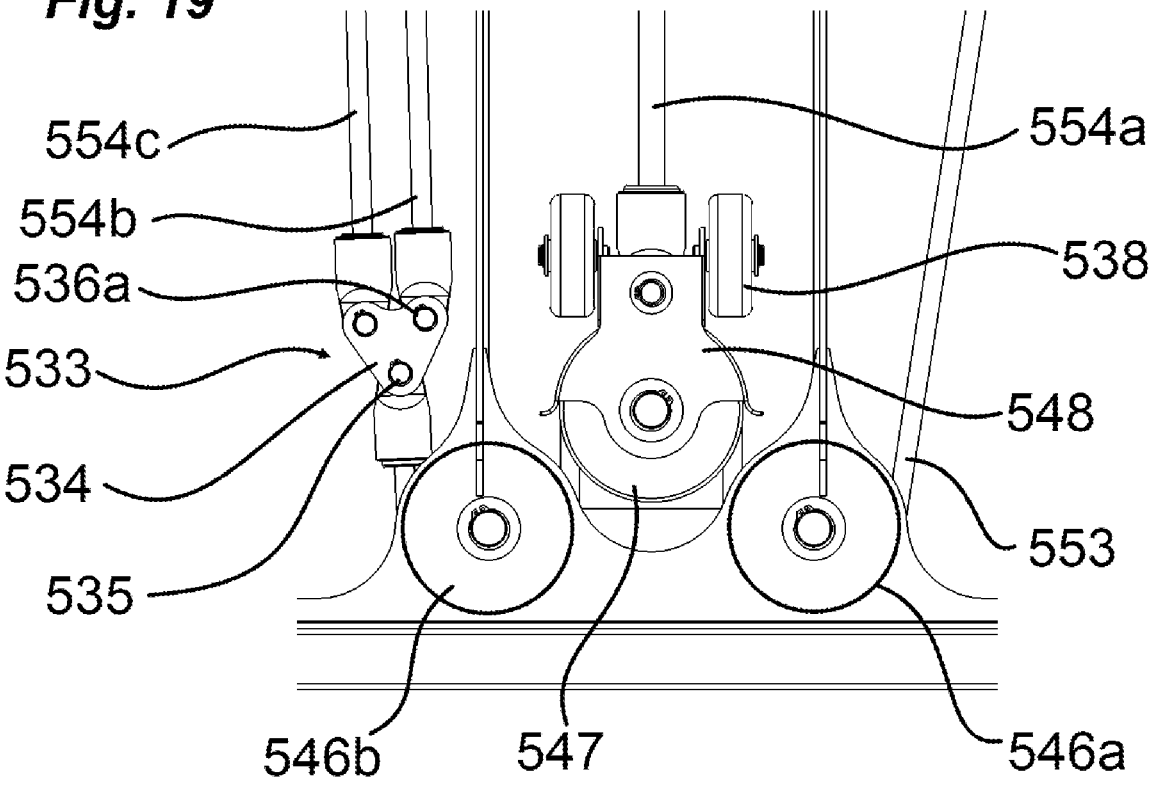
FIG. 19 is a detailed view from FIG. 18 showing additional components with greater clarity from a third embodiment of the present invention.

With particular reference to FIG. 19, a detailed view is shown providing a clearer view of 2:1 splitter coupling 533 as well as horizontal runner 548. As shown in FIG. 19, 2:1 splitter coupling 533 comprises a set of ear plates 534 and pins 535, 536 which connect rope 553 to ropes 554*b* and 554*c*. A Person of Ordinary Skill in the Art will recognize that 2:1 splitter coupling 533 allows a summation of forces on ropes 554*b* and 554*c* to be transmitted to rope 553 with minimal shift in longitudinal position. For instance, if ropes 554*b* and 554*c* have equal amounts of tension, then the 2:1 splitter coupling 533 will orient itself to an angle of 0° as shown in FIG. 19. On the other hand, if for instance, rope 554*b* has tension while rope 554*c* has no tension, then 2:1 splitter coupling 53 will orient itself until the pin 536*a* (connected with rope 554*b*) is in-line with pin 535. A Person of Ordinary Skill in the Art will recognize that at intermediate tension distribution conditions, 2:1 splitter coupling 533 will orient itself in intermediate angles to maintain equilibrium. As shown in FIG. 19, horizontal runner 548 comprises a pulley 547. Horizontal runner 548 may also be provided with wheels 538 which allow for smooth traveling in the longitudinal direction of the machine 501 when the center pull location 517 is be utilized.

Figure 20:
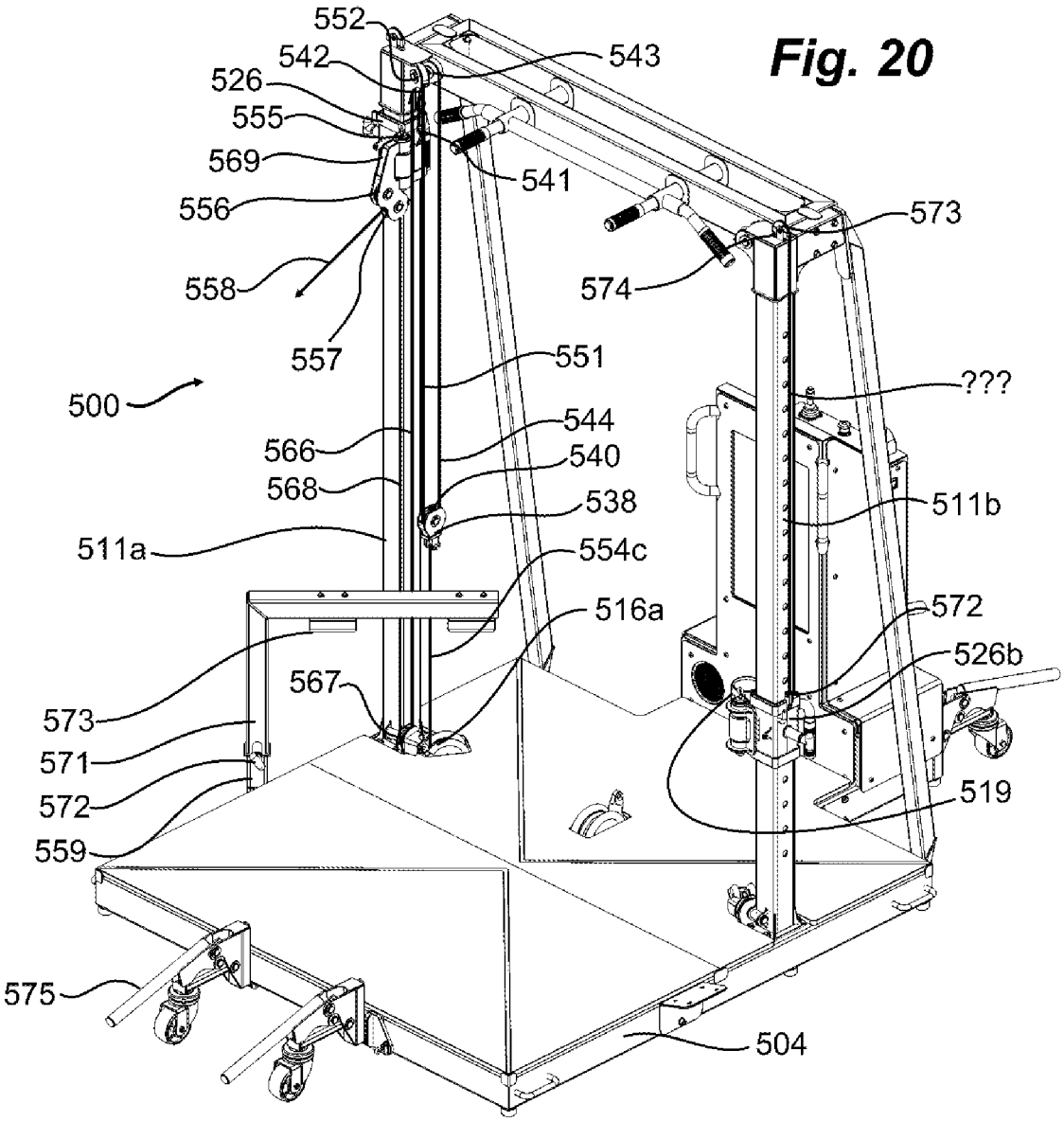
FIG. 20 is a perspective view of a third embodiment of the present invention in an alternative configuration.

With particular reference to FIG. 20, a perspective view is provided of machine 500 showing more particulars of how the post elements 511*a* and 511*b* are arranged. Post elements 511*a* and 511*b* are mirror images of each other, and each has every feature and function as the other. However, for the sake of clarity, some features are shown on one tower and others on the other tower. Similar to the apparatus shown in FIG. 14, rope extending from first pull location 516*a* extends upward toward a vertical runner 538 which has a pulley 540. A post rope segment 542 follows a path starting from anchor point 541 on collar 526. From the anchor point 541 the first post rope segment 542 travels vertically to a first tower pulley 543. From there, a second post rope segment 544 (integral with first post rope segment 542) travels vertically downward toward pulley 540 in the vertical runner 538. Second post rope segment 544 wraps around vertical runner pulley 540 and then runs vertically (as post rope segment 551) up to a second post pulley 552. The post rope next wraps around second post pulley 552 and runs vertically downward (as post rope segment 566) toward a third post pulley 567. The post rope next wraps around third post pulley 567 and travels vertically upward (as post rope segment 568) towards post swivel coupling 569. Post swivel coupling 569 is pinned to collar 526 through the use of a structural pin 555 which allows the post swivel coupling 569 to pivot about a vertical axis centered in the structural pin 555. Post swivel coupling is equipped with two pulleys 556, and 557 which act to redirect post rope segment 558 depending on whether it is pulled vertically upward or downward relative to the swivel coupling 569. A person of ordinary skill in the art will recognize that the post rope arrangement creates a 1:2 mechanical advantage over the pull force applied by the machine 500 at the first pull location 516*a*. Again, this tends to match the natural capacity of a human as in doing exercises from a post structure such as 511*a* and 511*b* (such as is well known in the exercise field) a human naturally has lower force generating capacity but higher speed capacity relative to for instance a squat type exercise. In this way, the machine capacity at the output segment 588 will be half the capacity of the base platform but twice the speed. Each post collar 526 may be outfitted with a support cup 519 or a post swivel coupling 569, depending on the exercise to be performed. With one or two post swivel couplings 569, a person of ordinary skill in the art will recognize great variety in the number of different exercises that can be accommodated. To accommodate an even greater number of exercise possibilities, the machine 500 may be provided with a removable structure designed to facilitate a lat-pulldown type exercise. As shown in FIG. 20, a lower beam 559 may be removably attached to the platform portion 504 of the machine 500. A lap bar 571 may be adjustably attached to lower beam 559 which extends over to a centered position relative to post 511*a*. Lap bar 571 may be provided with a spring-pin 572 which allows the height of the lap bar 571 to be adjusted vertically by corresponding with a set of vertically spaced holes (not shown) in the lower beam 559. Lap bar 571, if provided would preferentially have some means of pressure distribution to facilitate the comfort of the user during the lat pull down exercise. As shown, cushion elements 573 (consisting of a 1$^{st}$ and 2$^{nd}$ pad type supports) may be incorporated to allow the restraining force to be comfortably born by the user. Depending on the load capacity of the machine, the structure of the collars 526 and any attachments (swivel coupling 569 or support cup 519) may have a self-weight that makes vertical adjustment of the position of collar 526 inconvenient. To the extent that this is the case, a counterweight system may optionally be provided. As shown in FIG. 20, a counterweight system is provided beginning with a counterweight rope segment 574 which is anchored to collar 526*b* at anchor point 572 and travels vertically upward toward a top pulley 573 which it wraps around and travels vertically downward through a rope port 574 which attaches to a counterweight (not shown) internal to the post tube 511*b*. Optionally, machine 500 may be provided with a transport system which may have at least one wheel, shown in FIG. 20 as a set of kick-lift casters 575 or other means for facilitating the movement of the machine 500 from one location to another.

Figure 21:
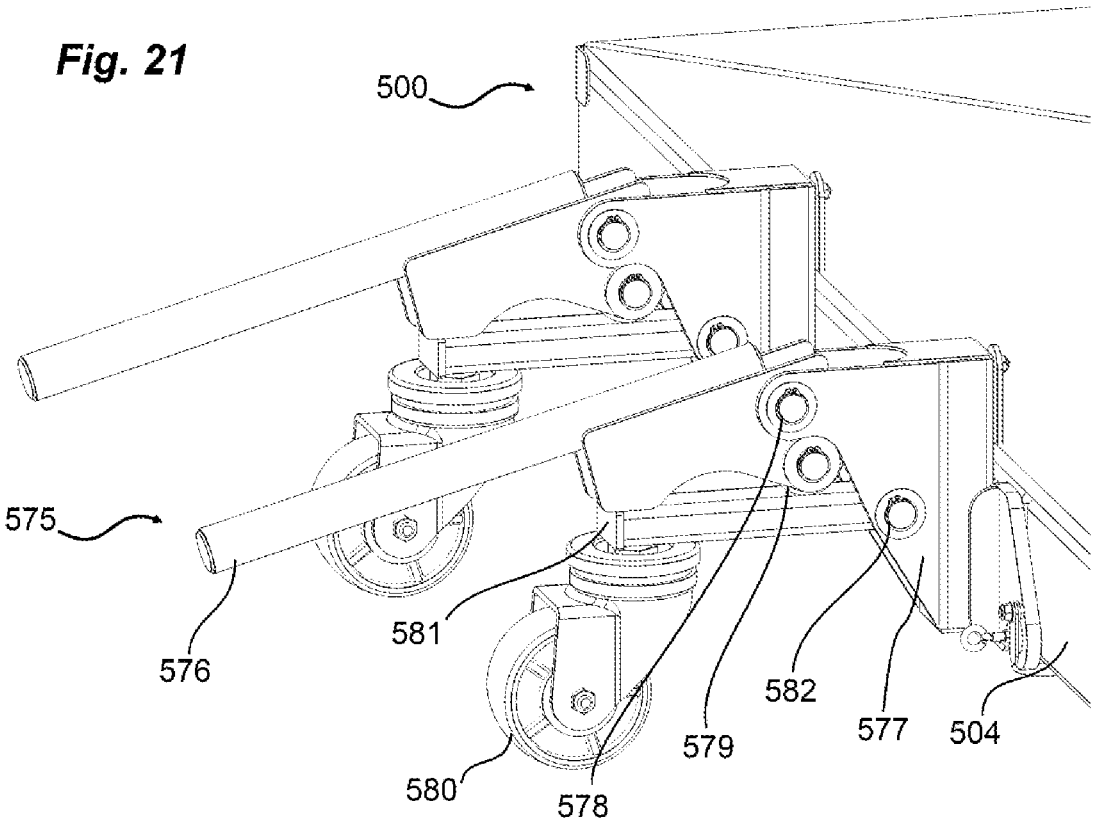
FIG. 21 is a perspective view of a kick-lift caster that may be used in conjunction with a third embodiment of the present invention.

With particular reference to FIG. 21, one embodiment of a transport system as a removable kick lift caster 575 is shown. As shown in FIG. 21, kick lift caster 575 is shown with a frame portion 577 removably attached to the platform portion 504 of the machine 500. The attachment may comprise a T-slot on the platform frame and a T on the transport system such that when the T is inserted into the T-slot, it can be moved upward into the stem of the T-slot to resist horizontal forces imposed when the wheel is lowered. Vertical forces are supported by the transport system bearing against the frame of the machine. A handle portion 576 is pivotally connected to the frame portion 577 via a pin 578 and is pivotable between a downward position (shown) and an upward position (not shown). Handle portion may be provided with a roller 579 which moves with handle portion 576 on an arcuate path around pin 578. A caster 580 of ordinary design may be provided and attached to a bar 581 which pivots on frame portion 577 about the axis of a pin 582. A Person of Ordinary Skill in the Art will recognize that this arrangement creates a linkage mechanism which if properly dimensioned allows the roller element 579 to move past a toggle point when the handle 576 is in lowered (shown) position. Once past the toggle point (as shown) the force balance on the linkage will tend to self-support, thereby maintaining the machine 500 in an elevated position. The platform may also be selectively lowered to the ground by applying an upward force on the handle portion 576 so as to move the linkage out of the toggled condition. As shown in FIG. 20, a preferred embodiment of the present invention may include 4 of such kick lift casters which when all put past their respective toggle positions, will completely suspend the machine 500 on the casters 580 allowing the machine to be relocated with relatively minimal effort. A person of ordinary skill in the art will recognize that many alternatives are possible to facilitate the movement of the machine 500 without departing from the scope of this disclosure. Kick-loft casters 575 may be removably attached to the machine 500 so as to keep the platform area free and clear of obstruction when the machine 500 is being transported.

Figure 22:
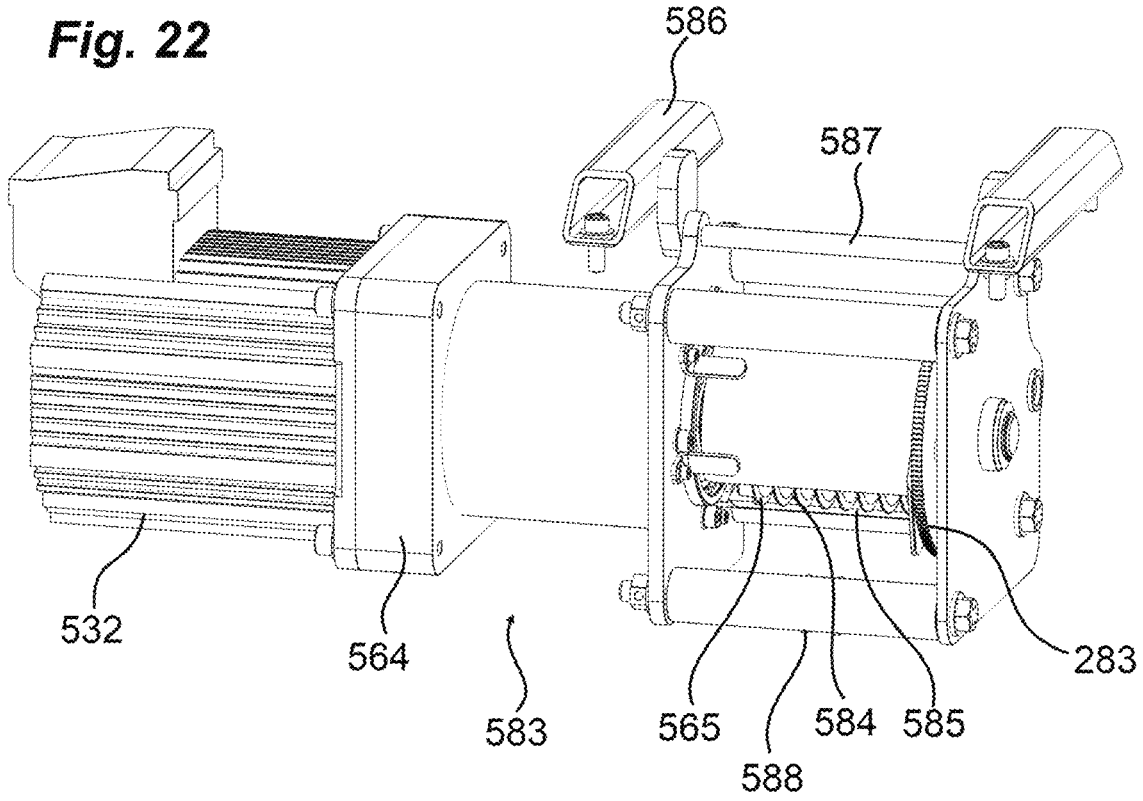
FIG. 22 is a perspective view of a winch and servo block that may be incorporated in a third embodiment of the present invention.

With particular reference to FIG. 22, a detailed view of the winch and servo block 583 is shown. Winch and servo block 583 comprises a servo motor 532, a gearbox 564, and a winch drum 565. To aid in rope retention and to control rope winding behavior, winch drum 565 may be provided with deep flared grooved 584 which more completely guide the winch rope (not shown) 553 as it winds onto and off of the winch drum 565 into the channel formed by the groove 584. To further aid in rope retention, the winch drum 565 may be surrounded by rope retaining covers 585 which have very narrow clearance over the winch drum 565, thereby allowing the rope to be guided into and out of the channel formed between the cover 585 and the drum 565. In addition to the auto-tensioner arrangement discussed previously, a person of ordinary skill in the art will recognize that the grooves 584 and the covers 585 provide additional features that aid in the proper winding of the rope 553 onto the winch drum 565. Winch and servo block may be mounted in the frame of control tower portion (not shown) 505 through a set of hanging bars 586 and a pivot pin 587. A retaining mechanism (not shown) may be attached to a retaining bar 588 and on its alternate end to the machine 500 to fully secure winch and servo block 583. The retaining mechanism (not shown) may be a load cell or a tension link.

A person of ordinary skill in the art will recognize that the present invention may be arranged in many different configurations without departing from the scope of this disclosure. For example, while the preferred embodiment may be best suited for a commercial institution such as a gym or collegiate training facility, a smaller, light-weight, and highly portable version of the present invention may be constructed as well. Such a machine may be provided with a lower maximum force capacity and be capable of being wheeled around by a single individual to be loaded into a car or truck or onto a small trailer. The lower maximum force capacity may be better suited to the common consumer and would allow the machine to be constructed to a lighter overall weight, further enhancing its mobility.

Thus, while there has been shown and described, fundamental novel features of the disclosure as applied to various specific embodiments thereof, it will be understood that 14 various omissions and substitutions and changes in the form and details of the apparatus illustrated, and in their operation, may be made by those skilled in the art without departing from the spirit of the disclosure. For example, it is expressly intended that all combinations of those elements which perform substantially the same function, in substantially the same way, to achieve the same results, are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore to be limited only as indicated by the scope of the claims appended hereto.

What is claimed is:

1. An exercise system comprising:

a platform, whereby a portion of the platform is configured to support a performance of an exercise movement thereon;

a pull location that includes one or more tension supporting members;

a force coupler connected to the one or more tension supporting members, wherein the force coupler is configured for accepting a force exerted by a user of the exercise system;

a displacement-based control system connected to the platform and configured to control a displacement of the one or more tension supporting members in or out of the platform using an actuator;

a locking plate; and a locking pawl configured to move toward the locking plate to lock the displacement-based control system, whereby the displacement of the one or more tension supporting members is independent of the force exerted by the user on the one or more tension supporting members.

2. The exercise system of claim 1, further comprising an encoder, wherein the encoder allows the displacement of the one or more tension supporting members in or out of the platform to be determined.

3. The exercise system of claim 2, further comprising a load cell, wherein the load cell allows a force applied to the one or more tension supporting members by the user to be determined.

4. The exercise system of claim 3, wherein the displacement-based control system is configured for directing movement of the actuator, and a directional control instrument for relaying a signal from the user to the control system.

5. The exercise system of claim 4, further comprising a software application, wherein the software application is configured to accept inputs from the user and send data signals to the displacement-based control system, wherein the inputs may be provided electronically by means of the directional control instrument, a biometric device, an audio or tactile command.

6. The exercise system of claim 5, wherein the software application may be configured to enable the actuator to modulate a tensity of the one or more tension supporting members.

7. The exercise system of claim 4, wherein the directional control instrument is further configured to be accessible to the user for operation by the user while the user is engaged in the performance of the exercise movement using the exercise system.

8. The exercise system of claim 3, further comprising a display, wherein the display is configured to visually display a level of force exerted by the user, whereby the level of force is measured by the load cell, and wherein the display device is further configured to display a position of the one or more tension supporting members, whereby the position of the one or more tension supporting members is determined by the encoder.

9. The exercise system of claim 1, further comprising a second pull location that includes one or more second tension supporting members, and a coupler, whereby the coupler couples a first of the one or more tension supporting members and a second tension supporting member of the one or more second tension supporting members to a third tension supporting member; whereby the first and second tension supporting members displace substantially the same distance as the third tension supporting member regardless of the force applied to the first and second tension supporting members.

10. The exercise system of claim 9, further comprising:

a post; and a collar, whereby the collar is configured for slidable engagement with the post and wherein the collar may be selectively locked in position relative to the post.

11. The exercise system of claim 10, further comprising a pulley system connected to the post, wherein a first end of a fourth tension supporting member terminates on the collar and passes over a vertical running pulley, and wherein a second end of the fourth tension supporting member is extensible away from the post, wherein the first of the one or more tension supporting members is connected to the vertical running pulley, and a second force coupler is connected to the fourth tension supporting member, and wherein the second force coupler is configured to accept a pulling force from the user.

12. The exercise system of claim 10, whereby the first of the one or more tension supporting members passes through a support cup, wherein the support cup is configured to prevent the force coupler from traveling past the support cup.

13. The exercise system of claim 10, further comprising a counterweight system, wherein the counterweight system is provided to offset a first weight of the collar and a second weight of devices attached to the collar, such that if the collar is not locked relative to the post, the user may slide the collar in an upward or downward direction, with less force than a combined first weight of the collar and the second weight of devices attached to the collar.

14. The exercise system of claim 1, further comprising a kick lift caster, wherein the kick lift caster is mounted to the platform for facilitating transportation of the exercise system.

15. The exercise system of claim 14, wherein the kick lift caster comprises one or more wheels which may be deployed to raise the exercise system off of a surface and alternately may be retracted to lower the exercise system to the surface.

16. The exercise system of claim 14, wherein the kick lift caster is removably mounted to the platform.

17. The exercise system of claim 14, wherein the kick lift caster is removably mounted using a T-plate and a T-slot.

18. The exercise system of claim 1, wherein the platform comprises a plurality of segments, and wherein the plurality of segments may be configured to be substantially planar and whereby the plurality of segments may be further fixedly locked in a substantially planar configuration.

19. The exercise system of claim 18, wherein one or more of the plurality of segments is foldable relative to the remaining one or more of the plurality of segments.

20. The exercise system of claim 1, wherein the one or more tension supporting members comprises a synthetic fiber rope.

21. The exercise system of claim 1, wherein the actuator comprises at least one of a screw, a winch, a fluid power cylinder, or other linear actuation device.

22. The exercise system of claim 1, further comprising at least one of:

a pulley configured to guide a first of the one or more tension supporting members in or out of the platform;

a fairlead configured to direct one of the one or more tension supporting members onto a pulley;

a self-aligning pulley, wherein the self-aligning pulley is configured to rotate about an axis to align with a direction of a force applied to the force coupler.

23. The exercise system of claim 1, wherein the displacement-based control system further comprises at least one of:

a winch drum, wherein the winch drum includes a channel, and wherein the channel is dimensioned and configured to retain and guide one of the one or more tension supporting members within the channel and onto the winch drum when the winch drum moves in a first direction and to guide one of the one or more tension supporting members off of the winch drum when the winch drum moves in a second direction, wherein movement of the winch drum in the second direction is opposite a movement of the winch drum in the first direction; or a tensioner configured to maintain a tensity of the one or more tension supporting members as one of the one or more tension supporting members winds onto or off of a winch drum.

24. The exercise system of claim 1, further comprising a safety mechanism, wherein the safety mechanism comprises at least one of:

an emergency stop to prevent retraction of the one or more tension supporting members; or a touch switch to recognize a presence of the user or operator and prevent retraction of the one or more tension supporting members when the user or the operator is not sensed.

25. The exercise system of claim 1, further comprising:

a tower for housing the displacement-based control system within the tower; whereby the displacement-based control system includes one or more of: a directional control instrument; an electronic processor; and wherein a portion of the tower is connected to the platform.

26. The exercise system of claim 1, further comprising a framework configured to support an exercise bar in an elevated position relative to the platform, wherein the force coupler includes an attachment to connect a portion of the user's body to the one or more tension supporting members, such that when the user is performing an exercise with the exercise bar, the attachment moves with one of the one or more tension supporting members.

27. The exercise system of claim 1, further comprising a first padding and a second padding, wherein the first padding and the second padding are configured for bracing a portion of the body of the user, when the user is exerting a force on the force coupler.

28. An electro-mechanical exercise system comprising:

a platform having a pull location, the platform coupled to a control system for selectively directing at least some movement of one or more tension supporting members connected to a force coupler;

wherein the control system comprises an actuator configured to direct movement of the one or more tension supporting members; and wherein the pull location is operatively connected with a portion of the one or more tension supporting members to enable a force to be exerted on the one or more tension supporting members operatively connected to the actuator, wherein the control system is configured to receive a parameter for preselecting at least one each of an upper limit position of the force coupler and a lower limit position of the force coupler.

29. The exercise system of claim 28, wherein the actuator is coupled to the one or more tension supporting members to control the speed, direction of movement, or position of the force coupler.

30. The exercise system of claim 29, wherein the actuator comprises a motor and a gearbox.

31. The exercise system of claim 30, wherein the gearbox is coupled with a screw mechanism, and wherein the screw mechanism is further coupled to the one or more tension supporting members.

32. The exercise system of claim 30, wherein the gearbox is coupled to a winch drum, and whereby one of the one or more tension supporting members is wound onto the winch drum.

33. The exercise system of claim 28, wherein the one or more tension supporting members is flexible, and whereby the pull location includes a fairlead positioned over a wheel, the wheel further including a channel, and wherein the fairlead guides the one or more tension supporting members into the channel or onto a plurality of teeth of the wheel to allow the one or more tension supporting members to cooperate with the wheel over a plurality of angles, from which the one or more tension supporting members may be drawn out of, or retracted into the platform.

34. The exercise system of claim 33, wherein the pull location further includes a stop, wherein the stop is positioned between a thimble, the fairlead and a pulley, and wherein the stop prevents the one or more tension supporting members from being retracted into the platform.

35. The exercise system of claim 34, wherein the thimble includes a first protuberance positioned on a first side of the thimble and a second protuberance positioned on a second side of the thimble, wherein the second side of the thimble is opposite to the first side and wherein the thimble is attachable to the one or more tension supporting members.

36. The exercise system of claim 28, wherein the control system comprises an electronic processor, a directional control instrument, a touch switch to sense a presence of a user, an electronic switch to stop operation of the exercise system and a display.

37. The exercise system of claim 36, wherein the display comprises a touchscreen.

38. The exercise system of claim 37, wherein the touchscreen includes a graphical user interface, and wherein the graphical user interface provides for set-up of an exercise regimen and for processing data of force exertion by the user and extension of the one or more tension supporting members.

39. The exercise system of claim 36, wherein at least one of the directional control instrument or the touch switch is configured to require continuous input from the user or an operator for maintaining a motion of the one or more tension supporting members.

40. The exercise system of claim 28, further comprising a load cell configured to allow measurement of a force in the one or more tension supporting members.

41. The exercise system of claim 40, wherein an on-board computer system receives displacement data from an encoder and wherein the on-board computer system further receives force data transmitted from the load cell, whereby the on-board computer system processes displacement data of the force coupler and force exertion data of a force exerted by a user on the one or more tension supporting members, and wherein the displacement data and force exertion data is shown on a display.

42. The exercise system of claim 40, wherein a first end of the load cell is connected to the platform and a second end of the load cell is connected to a winch, wherein the winch is movably attached to the platform.

43. The exercise system of claim 28, wherein the platform comprises a plurality of segments, wherein a first segment of the plurality is attached to a second segment of the plurality at a first side of the first segment, and wherein the first segment and the second segment may be configured in a stowed or deployed position, and wherein the first segment and the second segment may be selectively locked in the deployed position.

44. The exercise system of claim 43, wherein when the second segment is folded into the stowed position relative to the first segment, a platform portion has a width that is less than thirty-six inches.

45. The exercise system of claim 28, further comprising a second pull location which is operatively connected with a second portion of one of the one or more tension supporting members.

46. The exercise system of claim 45, further including a third pull location, wherein at least one of the pull locations is centrally located on the platform.

47. The exercise system of claim 45, wherein a first tension supporting member and a second tension supporting member of the one or more tension supporting members connect the actuator to a system of pulleys, wherein the system of pulleys is configured to connect the actuator to the first tension supporting member and the second tension supporting member.

48. The exercise system according to claim 28, wherein the one or more of the tension supporting members comprises a synthetic fiber rope.

49. The exercise system of claim 28, further including a single-user control whereby the single-user control may be hand-held or positioned adjacent to the force coupler such that a user may use the single-user control in conjunction with the force coupler, and wherein the single-user control is in electronic communication with the control system, and wherein the control system is further configured to control the speed, direction, position or movement of the actuator, thereby causing the control system to effect an extension or retraction of the one or more tension supporting members connected to the force coupler.

50. The exercise system of claim 28, further including a first post and a second post for supporting the force coupler, wherein each of the first post and the second post further include a plurality of rail support arms, wherein each of the plurality of the rail support arms further includes protuberances to a rotational axis, wherein the protuberances are configured to allow each of the rail support arms to toggle between a first position and a second position, such that each of the plurality of rail support arms is spaced apart at a first distance in the first position, wherein the first distance is greater relative to a second distance, wherein the second distance is the spacing of each of the plurality of rail support arms in the second position and such that in the second position the support arms of the plurality are configured to support a standard barbell for performing traditional weight based exercise movements, while in the first position the rail support arms are spaced further apart than in the second position, allowing the one or more tension supporting members to be connected to a barbell as the force coupler.

51. A method of operating an electro-mechanical exercise system, the method comprising:

connecting a platform to a control system comprising an actuator;

controlling at least some movement of a tension supporting member connected to a force coupler with the control system;

positioning at least a portion of the tension supporting member at a pull location on the platform;

operatively connecting the pull location with the tension supporting member;

selectively exerting a force on the tension supporting member operatively connected to the actuator;

tracking a position of the force coupler with the control system; and displaying the position of the force coupler.

52. The method of claim 51, further comprising entering parameters for preselecting any one or more of a set number of repetitions of an exercise regimen, a time delay within the exercise regimen, an isometric pause within the exercise regimen, an upper or lower limit for a carriage to travel within the exercise regimen, or speed of travel of the actuator within the exercise regimen.

53. The method of claim 52, further comprising entering a parameter for preselecting: at least one each of an upper limit position of the force coupler and a lower limit position of the force coupler, within the exercise regimen.

54. The method of claim 51, further comprising entering parameters for an exercise regimen, wherein the parameters include an option for a trainer mode or a single user mode;

wherein the trainer mode enables a trainer to control a movement of the actuator and disables the single user mode; and wherein the single user mode enables a user to control the movement of the actuator and disables the trainer mode.

55. The method of claim 51, wherein displaying the position of the force coupler comprises displaying a plot of the position of the force coupler and a force exerted by the user and parameters of time and force output as graphical elements.

56. The method of claim 51, further comprising stopping or reversing the actuator.

57. The method of claim 51, further comprising controlling a position of the tension supporting member irrespective of the force exerted by a user on the force coupler.

58. The method of claim 51, further comprising gauging a user's performance with a biometric device, and wherein the biometric device transmits information to the system for displaying, modifying, or terminating an exercise regimen based on metrics relating to the user's performance.

59. The method of claim 51, further comprising enabling a user to control the actuator and control system with a remote control.

60. An exercise system comprising:

a control system comprising an actuator;

a platform connected to the control system;

a pull location positioned on the platform, wherein a tension supporting member is coupled at a first end to the actuator and passes through the pull location, and wherein the tension supporting member is configured to retract into the platform or extend from the platform;

wherein a force coupler is connected to the tension supporting member at a second end, and wherein the force coupler is configured to selectively receive a pulling force;

a display configured to show a tracked position of the force coupler and a force exerted by a user on the force coupler; and an opening dimensioned for receiving the tension supporting member within the opening, wherein the opening is dimensioned to be narrow relative to the force coupler, such that the force coupler may not be received within the opening, and wherein the opening for the tension supporting member limits a range of motion of the force coupler.

61. The exercise system of claim 60, wherein the force coupler is a barbell and wherein the opening limits the range of motion of the barbell.

62. The exercise system of claim 60, wherein the tension supporting member comprises a synthetic fiber rope.

* * * * *